US005741549A

United States Patent [19]

Maier et al.

[11] Patent Number: 5,741,549

[45] Date of Patent: Apr. 21, 1998

[54] SLIDE DIE COATING METHOD AND APPARATUS WITH IMPROVED DIE LIP

[76] Inventors: Gary W. Maier; Omar D. Brown, both of P.O. Box 33427, St. Paul, Minn. 55133-3427

[21] Appl. No.: 726,331

[22] Filed: Oct. 3, 1996

Related U.S. Application Data

[63] Continuation-in-part of Ser. No. 510,899, Aug. 3, 1995, abandoned, which is a continuation of Ser. No. 236,569, Apr. 29, 1994, abandoned.

[51] Int. Cl.[6] ..... B05D 1/26; B05C 5/02

[52] U.S. Cl. ..... 427/294; 427/402; 118/410; 118/411

[58] Field of Search ..... 427/294, 356, 427/358, 359, 402, 428; 118/410, 411

[56] References Cited

U.S. PATENT DOCUMENTS

| | | | |
|---|---|---|---|
| 2,681,294 | 6/1954 | Beguin | 117/34 |
| 2,761,791 | 9/1956 | Russell . | |
| 3,413,143 | 11/1968 | Cameron et al. | 117/120 |
| 3,627,564 | 12/1971 | Mercier | 427/358 |
| 3,903,843 | 9/1975 | Jones | 118/412 |
| 3,996,885 | 12/1976 | Jackson et al. | 118/411 |
| 4,113,903 | 9/1978 | Choinski . | |
| 4,283,443 | 8/1981 | Choinski . | |
| 4,443,504 | 4/1984 | Burket et al. . | |
| 4,445,458 | 5/1984 | O'Brien | 118/401 |
| 4,489,671 | 12/1984 | Choinski . | |
| 4,774,109 | 9/1988 | Hadzimihalis et al. . | |
| 4,842,900 | 6/1989 | Miyamoto . | |
| 5,030,484 | 7/1991 | Chino et al. . | |
| 5,256,357 | 10/1993 | Hayward | 264/171 |

FOREIGN PATENT DOCUMENTS

| | | |
|---|---|---|
| 0 111 338 | 6/1984 | European Pat. Off. . |
| 0 552 653 A1 | 7/1993 | European Pat. Off. . |
| 0 566 124 A1 | 10/1993 | European Pat. Off. . |
| 4-190870 | 7/1992 | Japan . |
| 1 266 745 | 3/1972 | United Kingdom . |
| WO 92/17816 | 10/1992 | WIPO . |
| WO 93/14878 | 8/1993 | WIPO . |

*Primary Examiner*—Katherine A. Bareford
*Attorney, Agent, or Firm*—Charles D. Levine

[57] ABSTRACT

A slide die coating method and apparatus includes a die having an upstream bar with an upstream lip, a manifold bars a downstream bar with a downstream lip, a vacuum bar, and a slide surface. The upstream lip is formed as a land and the first manifold bar is formed as a sharp edge. The coating fluid exits the die from a passageway and slides along the slide surface to form a continuous coating bead between the manifold bar sharp edge, the upstream die lip, and the surface being coated. The shape of the land conforms to the shape of the surface being coated. The die can include multiple passageways for coating multiple layers.

8 Claims, 18 Drawing Sheets

| VIS (CPS) | Vw (M/MIN) | | Tw (MICRONS) | | CTG GAP (MM) | | VAC (MM H20) | |
|---|---|---|---|---|---|---|---|---|
| | PRIOR | NEW | PRIOR | NEW | PRIOR | NEW | PRIOR | NEW |
| 37.6 | 9.1 | | 22.2 | | 0.076 | | 190.5 | |
| 37.6 | | 18.3 | | 15.4 | | 0.076 | | 96.5 |
| 37.6 | | 24.4 | | 15.4 | | 0.076 | | 101.6 |
| 39.5 | 18.3 | 18.3 | 42 | 31 | 0.076 | 0.124 | 132.1 | 43.2 |
| 39.5 | 36.6 | 36.6 | 47.2 | 31 | 0.076 | 0.099 | 165.1 | 93.9 |
| 47 | 30.5 | 30.5 | 45.7 | 45.7 | 0.102 | 0.254 | 109.2 | 5.1 |
| 131.4 | 18.3 | 18.3 | 62 | 62 | 0.102 | 0.264 | 66 | 0 |
| 131.4 | | 38.1 | | 62 | | 0.305 | | 0 |
| 140 | 12.2 | 12.2 | 33.8 | 23.1 | 0.076 | 0.081 | 101.6 | 104.1 |
| 158 | 9.1 | | 46.5 | | 0.076 | | 76.2 | |
| 158 | | 15.2 | | 23.2 | | 0.076 | | 167.6 |
| 600 | 15.2 | 15.2 | 177.3 | 177.3 | 0.254 | 0.432 | 0 | 0 |
| 600 | 24.4 | 24.4 | 177.3 | 177.3 | 0.254 | 0.305 | 25.4 | 0 |

FIG. 13

SLIDE DIE COATING METHOD AND APPARATUS WITH IMPROVED DIE LIP

This is a continuation-in-part of application Ser. No. 08/510,899, filed Aug. 3, 1996, now abandoned, which is a continuation of application Ser. No. 08/236,569, filed Apr. 29, 1994, now abandoned.

TECHNICAL FIELD

The present invention relates to coating methods. More particularly, the present invention relates to coating methods using a die.

BACKGROUND OF THE INVENTION

U.S. Pat. No. 2,681,294 discloses a vacuum method for stabilizing the coating bead for direct extrusion and slide types of metered coating systems. Such stabilization enhances the coating capability of these systems. However, these coating systems lack sufficient overall capability to provide the thin wet layers, even at very low liquid viscosities, required for some coated products.

U.S. Pat. No. 4,445,458 discloses an extrusion type bead-coating die with a beveled draw-down surface to impose a boundary force on the downstream side of the coating bead and to reduce the amount of vacuum necessary to maintain the bead. Reduction of the vacuum minimizes chatter defects and coating streaks. To improve coating quality, the obtuse angle of the beveled surface with respect to the slot axis, and the position along the slot axis of the bevel toward the moving web (overhang) and away from the moving web (underhang) must be optimized. The optimization results in the high quality needed for coating photosensitive emulsions. However, the thin-layer performance capability needed for some coated products is lacking.

U.S. Pat. No. 4,443,504 discloses a slide coating apparatus in which the angle between the slide surface and a horizontal datum plane ranges from 35° to 50° and the takeoff angle defined between a tangent to the coating roll and the slide surface ranges from 85° to 100°. Operation within these ranges provides a compromise between performance from high fluid momentum down the slide and coating uniformity from high liquid levelling force against the slide surface. However, even with a vacuum chamber, this system does not provide the performance needed for some coated products.

European Patent Application No. EP 552653 describes covering a slide coating die surface adjacent to and below the coating bead with a low energy fluorinated polyethylene surface. The covering starts 0.05–5.00 mm below the coating lip tip and extends away from the coating bead. The low-surface-energy covering is separated from the coating lip tip by a bare metal strip. This locates the bead static contact line. The low energy covering eliminates coating streaks and facilitates die cleanup. No mention is made of using this with an extrusion coating die.

FIG. 1 shows a known coating die 10 with a vacuum chamber 12 as part of a metered coating system. A coating liquid 14 is precisely supplied by a pump 16 to the die 10 for application to a moving web 18, supported by a backup roller 20. Coating liquid is supplied through a channel 22 to a manifold 24 for distribution through a slot 26 in the die and coating onto the moving web 18. As shown in FIG. 2, the coating liquid passes through the slot 26 and forms a continuous coating bead 28 between the upstream die lip 30 and the downstream die lip 32, and the web 18. Dimensions $f_1$ and $f_2$, the width of the lips 30, 32 commonly range from 0.25 to 0.76 mm. The vacuum chamber 12 applies a vacuum upstream of the bead to stabilize the bead. While this configuration works adequately in many situations, there is a need for a die coating method which improves the performance of known methods.

SUMMARY OF THE INVENTION

The present invention is a die coating apparatus for coating multiple layers of fluid coating onto a surface. The apparatus includes a die having an upstream bar with an upstream lip, a wedge bar with a wedge edge, and a downstream bar with a downstream lip. The upstream lip is formed as a land, the wedge edge is formed as a sharp edge, and the downstream lip is formed as a sharp edge. A first passageway runs through the die between the upstream bar and the wedge bar and a second passageway running through the die between the wedge bar and the downstream bar. The first passageway has a first slot defined by the upstream lip and the wedge edge and the second passageway has a second slot defined by the wedge edge and the downstream lip. A first coating fluid exits the die from the first slot to form a continuous coating bead between the upstream die lip, the wedge edge, and the surface being coated for application onto the surface being coated. A second coating fluid exits the die from the second slot to form a continuous coating bead between the wedge edge, the downstream die lip, and the surface being coated for application onto the first coating fluid. The bead does not significantly move into the space between the land and the surface to be coated even as vacuum is increased.

The shape of the land conforms to the shape of the surface being coated. Where the surface is curved, the land is curved. The die also can include applying a vacuum upstream of the bead to stabilize the bead. The vacuum can be applied using a vacuum chamber having a vacuum bar with a land. The shape of the vacuum land also conforms to the shape of the surface being coated. The land and the vacuum land can have the same radius of curvature and can have the same or different convergences with respect to the surface to be coated.

Changing at least one of the slot height, the overbite, and the convergence can improve coating performance. The slot height, the overbite, and the convergence are selected in combination with each other and the length of the land, the edge angle of the downstream bar, the die attack angle between the downstream bar surface of the coating slot and a tangent plane through a line on the surface to be coated parallel to, and directly opposite, the sharp edge, and the coating gap distance between the sharp edge and the surface to be coated are selected in combination with each other.

In an alternative embodiment, the die includes an upstream bar with an upstream lip, a separator, and a downstream bar with a downstream lip. The upstream lip is formed as a land and the downstream lip is formed as a sharp edge. A first passageway runs through the die between the upstream bar and the separator and a second passageway runs through the die between the separator and the downstream bar. The first and second passageways combine to form a single slot defined by the upstream lip and the downstream lip. The two coating fluids are brought together inside the die slot and flow through the slot as separate, laminar layers which form a coating bead and transfer to the surface to be coated.

The method of die coating according to this invention includes passing a first coating fluid through a first slot; passing a second coating fluid through a second slot; forming a continuous coating bead with the first coating fluid between the upstream die lip, the wedge edge, and the surface being coated for application onto the surface being coated; and forming a continuous coating bead with the second coating fluid between the wedge edge, the downstream die lip, and the surface being coated for application onto the first coating fluid. The bead does not significantly move into the space between the land and the surface to be coated even as vacuum is increased.

The method can also include selecting the length of the land, the edge angle of the downstream bar, the die attack angle between the downstream bar surface of the coating slot and a tangent plane through a line on the surface to be coated parallel to, and directly opposite, the downstream lip sharp edge, and the coating gap distance between the downstream lip sharp edge and the surface to be coated in combination with each other; and selecting the slot height, the overbite, and the convergence in combination with each other. The method can also include the step of applying a vacuum upstream of the bead to stabilize the bead.

An alternative method includes passing a first coating fluid through a first passageway; passing a second coating fluid through a second passageway; bringing together the first and second coating fluids inside a die slot; flowing the first and second coating fluids through the slot as separate, laminar layers which form a coating bead; and transferring the bead to the surface to be coated.

The present invention is a die coating apparatus for coating fluid coating onto a surface. The apparatus includes a die having an upstream bar with an upstream lip, a manifold bar, a downstream bar with a downstream lip, a vacuum bar, and a slide surface. The upstream lip is formed as a land and the first manifold bar is formed as a sharp edge. A first passageway runs through the die between the manifold bar and the downstream bar. The coating fluid exits the die from the passageway and slides along the slide surface to form a continuous coating bead between the manifold bar sharp edge, the upstream die lip, and the surface being coated. The bead does not significantly move into the space between the land and the surface to be coated even as vacuum is increased. The shape of the land conforms to the shape of the surface being coated.

The invention also is a multiple layer die coating apparatus for coating multiple layers of fluid coatings onto a surface. This apparatus includes a die having an upstream bar with an upstream lip, a first manifold bar, a second manifold bar, a downstream bar with a downstream lip, a vacuum bar, and a slide surface. The upstream lip is formed as a land and the first manifold bar is formed as a sharp edge. A first passageway runs through the die between the first manifold bar and the second manifold bar. The first coating fluid exits the die from the first passageway and slides along the slide surface to form a continuous coating bead between the manifold bar sharp edge, the upstream die lip, and the surface being coated, for application onto the surface to be coated. A second passageway runs through the die between the second manifold bar and the downstream bar. The second coating fluid exits the die from the second passageway and slides along the slide surface to form a continuous coating bead between the manifold bar sharp edge, the upstream die lip, and the surface being coated, for application onto the first coating fluid.

The method of die coating according to this invention includes passing coating fluid through a passageway defined by a manifold bar having a sharp edge and a downstream bar with a downstream lip; and sliding the coating fluid exiting from the passageway along a slide surface to form a continuous coating bead between the manifold bar sharp edge, an upstream die lip formed as a land, and the surface being coated. The bead does not significantly move into the space between the land and the surface to be coated even as vacuum is increased.

The method can also include selecting the length of the land, the edge angle of the first manifold bar and the coating gap distance between the sharp edge and the surface to be coated in combination with each other; and selecting the overbite and the convergence in combination with each other.

A method of coating multiple layers includes passing a first coating fluid through a first passageway defined by a first manifold bar formed as a sharp edge and a second manifold bar; sliding the first coating fluid which exits from the first passageway along a slide surface; forming a continuous coating bead between the manifold bar sharp edge, an upstream die lip, and the surface being coated, for application of the first coating fluid onto the surface to be coated; passing a second coating fluid through a second passageway defined by the second manifold bar and a downstream bar; sliding the second coating fluid which exits from the second passageway along a slide surface; and forming a continuous coating bead between the manifold bar sharp edge, an upstream die lip, and the surface being coated, for application of the second fluid onto the first coating fluid.

BRIEF DESCRIPTION OF THE DRAWINGS

FIG. 13 is a collection of data from coating tests.

DETAILED DESCRIPTION

This invention is a die coating method and apparatus where the die includes a sharp edge and a land which are positioned to improve and optimize performance. The land is configured to match the shape of the surface in the immediate area of coating liquid application. The land can be curved to match a web passing around a backup roller or the land can be flat to match a free span of web between rollers.

Figure 1:
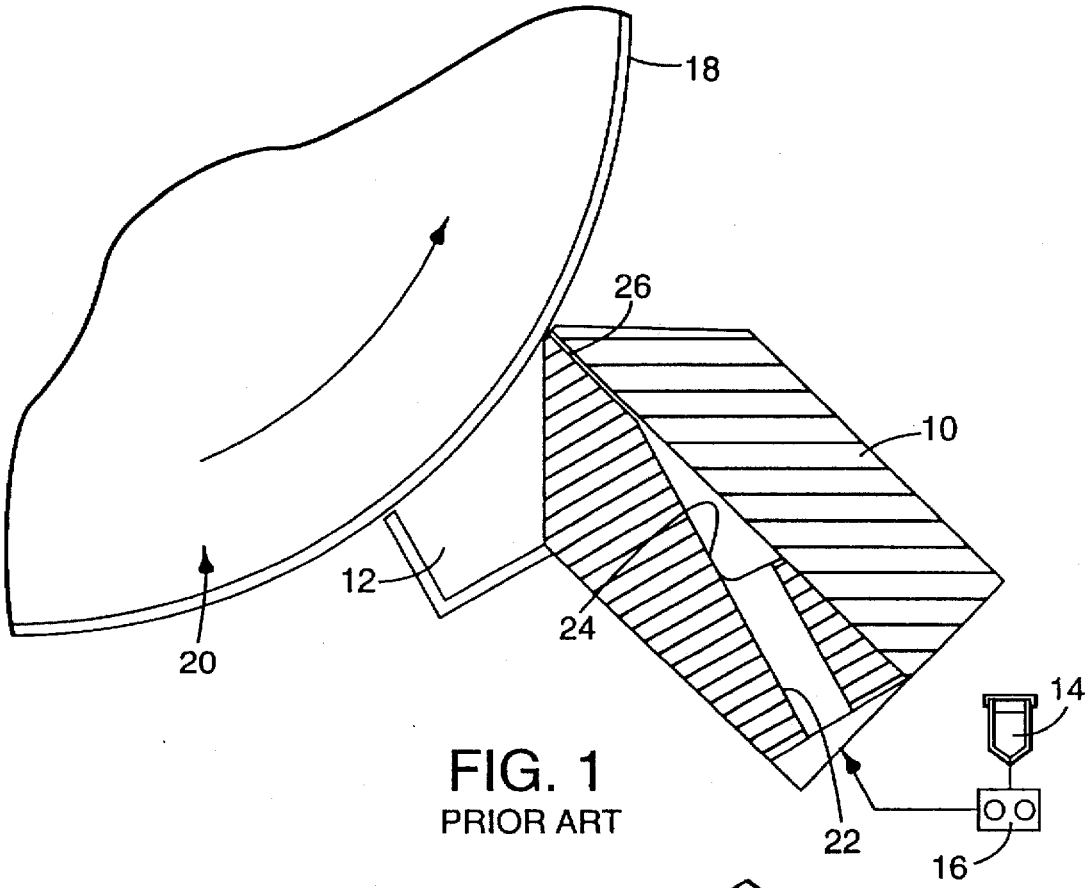
FIG. 1 PRIOR ART
FIG. 1 is a schematic, cross-sectional view of a known coating die.
Figure 2:
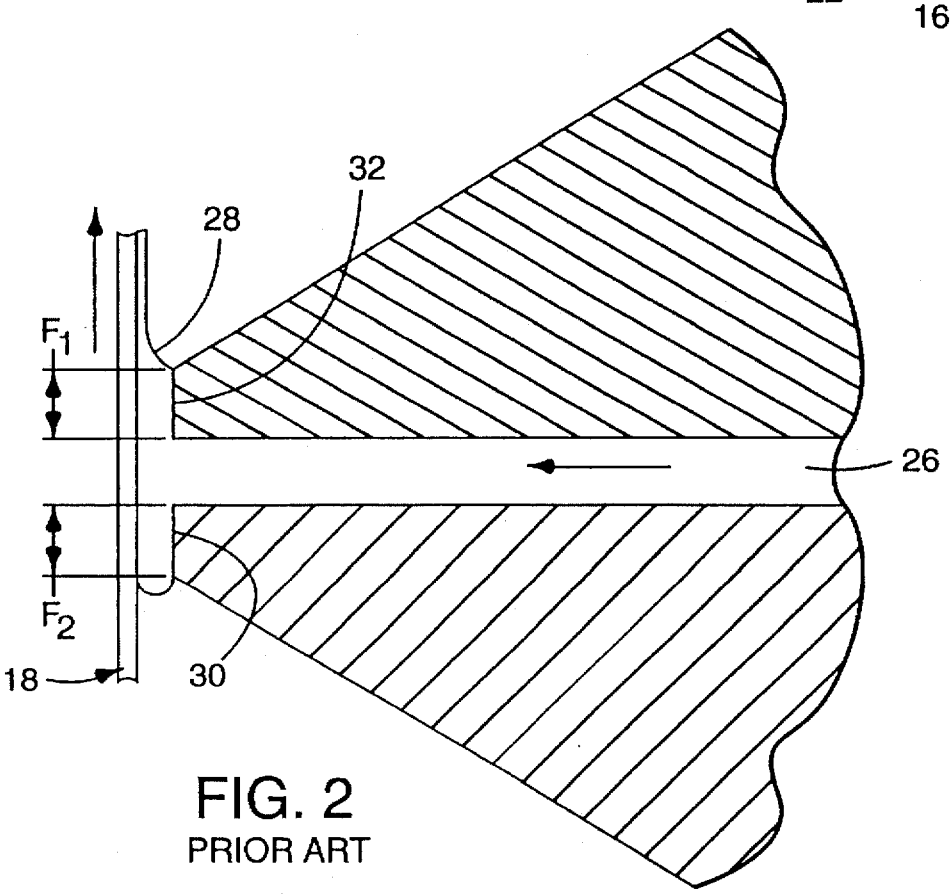
FIG. 2 PRIOR ART
FIG. 2 is an enlarged cross-sectional view of the slot and lip of the die of FIG. 1.
Figure 3:
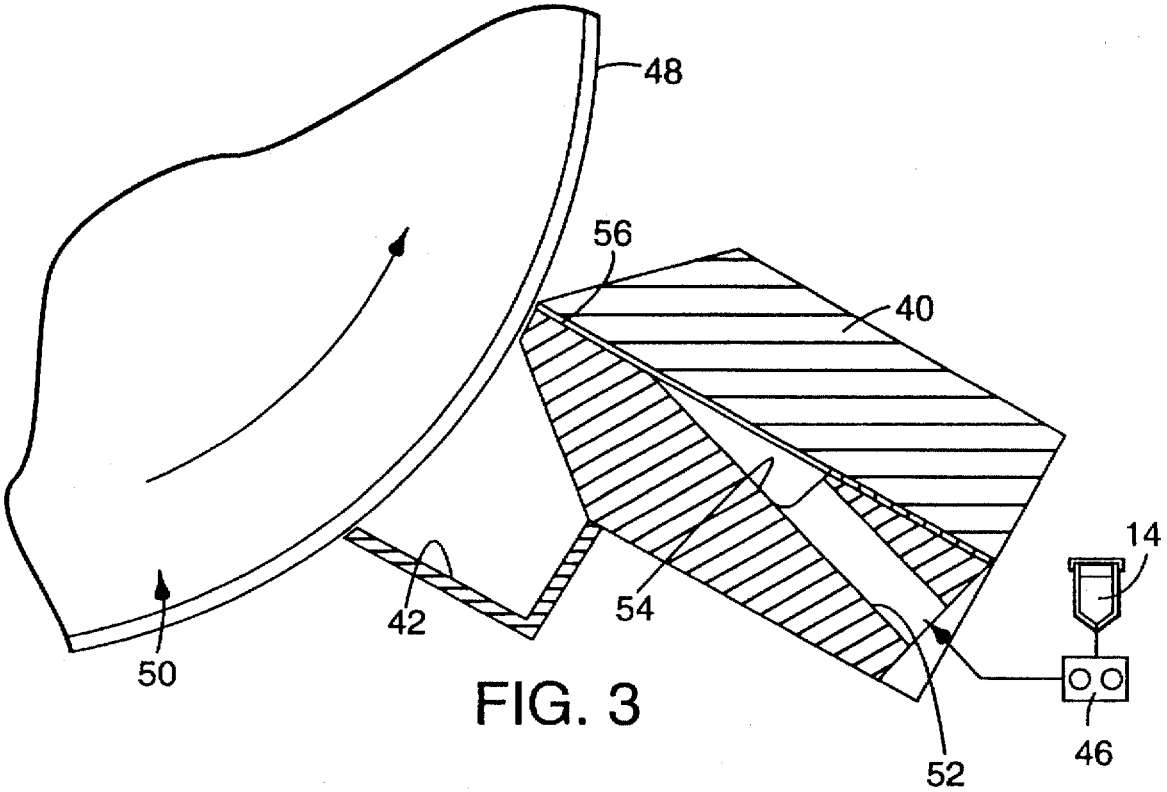
FIG. 3 is a cross-sectional view of an extrusion die of the present invention.
Figure 4:
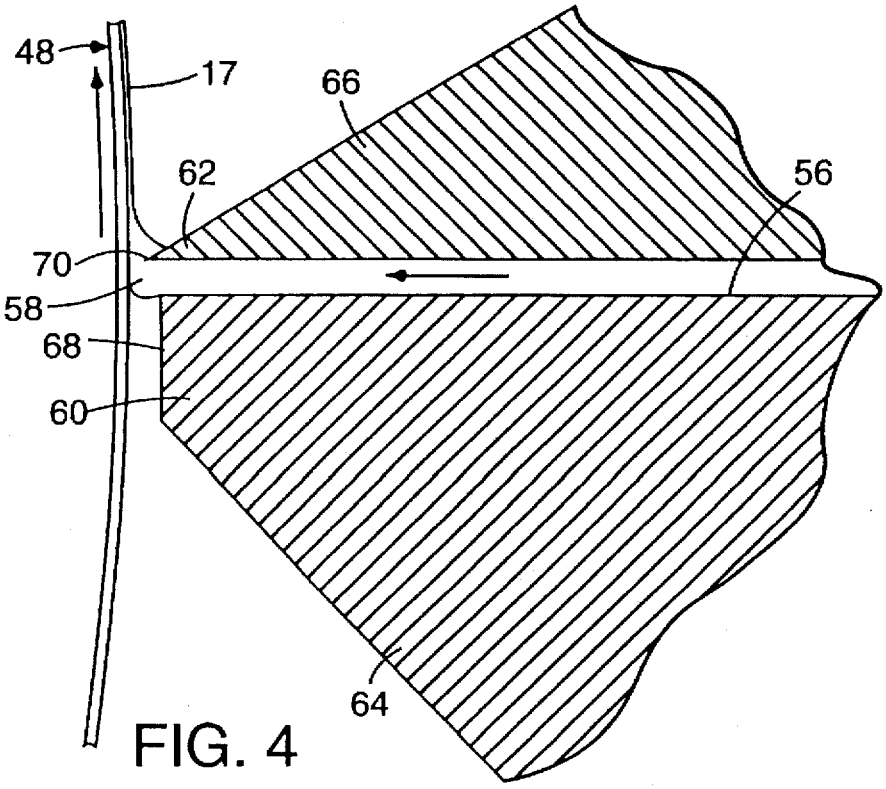
FIG. 4 is an enlarged cross-sectional view of the slot and lip of the die of FIG. 4.

FIG. 3 shows the extrusion die 40 with a vacuum chamber 42 of the present invention. Coating liquid 14 is supplied by a pump 46 to the die 40 for application to a moving web 48, supported by a backup roller 50. Coating liquid is supplied through a channel 52 to a manifold 54 for distribution through a slot 56 and coating onto the moving web 48. As shown in FIG. 4, the coating liquid 14 passes through the slot 56 and forms a continuous coating bead 58 among the upstream die lip 60, the downstream die lip 62, and the web 48. The coating liquid can be one of numerous liquids or other fluids. The upstream die lip 60 is part of an upstream bar 64, and the downstream die 62 lip is part of a downstream bar 66. The height of the slot 56 can be controlled by a U-shaped shim which can be made of brass or stainless steel and which can be deckled. The vacuum chamber 42 applies vacuum upstream of the bead to stabilize the coating bead.

Figure 5:
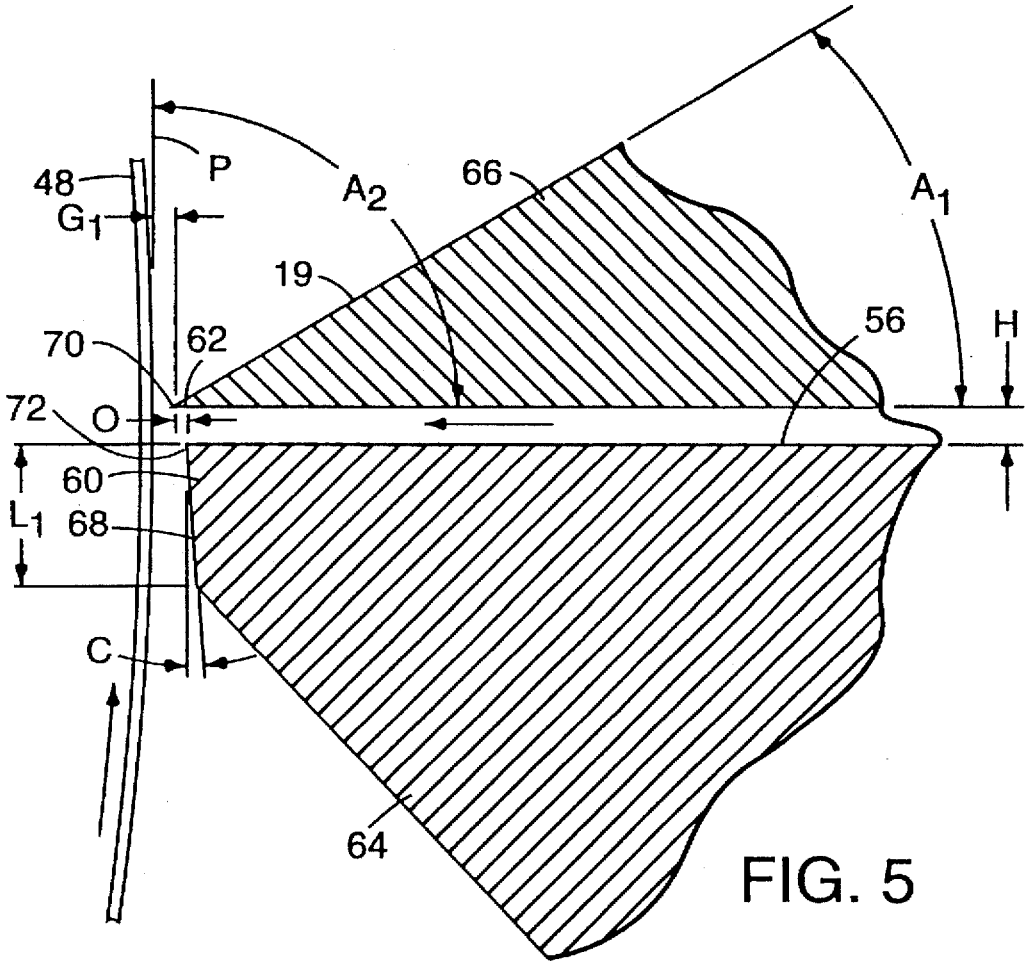
FIG. 5 is a cross-sectional view of the slot and lip similar to that of FIG. 4.

As shown in FIG. 5, the upstream lip 60 is formed as a curved land 68 and the downstream lip 62 is formed as a sharp edge 70. This configuration improves overall performance over that of known die-type coaters improved performance means permitting operating at increased web speeds and increased coating gaps, operating with higher coating liquid viscosities, and creating thinner wet coating layer thicknesses.

The sharp edge 70 should be clean and free of nicks and burrs, and should be straight within 1 micron in 25 cm of length. The edge radius should be no greater than 10 microns. The radius of the curved land 68 should be equal to the radius of the backup roller 50 plus a minimal, and non-critical, 0.13 mm allowance for coating gap and web thickness. Alternatively, the radius of the curved land 68 can exceed that of the backup roller 50 and shims can be used to orient the land with respect to the web 48. A given convergence C achieved by a land with the same radius as the backup roller can be achieved by a land with a larger radius than the backup roller by manipulating the land with the shims.

FIG. 5 also shows dimensions of geometric operating parameters for single layer extrusion. The length $L_m$ of the curved land 68 on the upstream bar 64 can range from 1.6 mm to 25.4 mm. The preferred length $L_1$ is 12.7 mm. The edge angle $A_1$ of the downstream bar 66 can range from 20° to 75°, and is preferably 60°. The edge radius of the sharp edge 70 should be from about 2 microns to about 4 microns and preferably less than 10 microns. The die attack angle $A_2$ between the downstream bar 66 surface of the coating slot 56 and the tangent plane P through a line on the web 48 surface parallel to, and directly opposite, the sharp edge 70 can range from 60° to 120° and is preferably 90°–95°, such as 93°. The coating gap $G_1$ is the perpendicular distance between the sharp edge 70 and the web 48. (The coating gap $G_1$ is measured at the sharp edge but is shown in some Figures spaced from the sharp edge for drawing clarity. Regardless of the location of $G_1$ in the drawings—and due to the curvature of the web the gap increases as one moves away from the sharp edge—the gap is measured at the sharp edge.)

Slot height H can range from 0.076 mm to 3.175 mm. Overbite O is a positioning of the sharp edge 70 of the downstream bar 66, with respect to the downstream edge 72 of the curved land 68 on the upstream bar 64, in a direction toward the web 48. Overbite also can be viewed as a retraction of the downstream edge 72 of the curved land 68 away from the web 48, with respect to the sharp edge 70, for any given coating gap $G_1$. Overbite can range from 0 mm to 0.51 mm, and the settings at opposite ends of the die slot should be within 2.5 microns of each other. A precision mounting system for this coating system is required, for example to accomplish precise overbite uniformity. Convergence C is a counterclockwise, as shown in FIG. 5, angular positioning of the curved land 68 away from a location parallel to (or concentric with) the web 48, with the downstream edge 72 being the center of rotation. Convergence can range from 0° to 2.29°, and the settings at opposite ends of the die slot should be within 0.023° of each other. The slot height, overbite, and convergence, as well as the fluid properties such as viscosity affect the performance of the die coating apparatus and method.

From an overall performance standpoint, for liquids within the viscosity range of 1,000 centipoise, it is preferred that the slot height be 0.18 mm, the overbite be 0.076 mm, and the convergence be 0.57°. Performance levels using other slot heights can be nearly the same. Holding convergence at 0.57°, some other optimum slot height and overbite combinations are as follows:

| Slot Height | Overbite |
|---|---|
| 0.15 mm | 0.071 mm |
| 0.20 mm | 0.082 mm |
| 0.31 mm | 0.100 mm |
| 0.51 mm | 0.130 mm |

In the liquid viscosity range noted above, and for any given convergence value, the optimum overbite value appears to be directly proportional to the square root of the slot height value. Similarly, for any given slot height value, the optimum overbite value appears to be inversely proportional to the square root of the convergence value.

Figure 6:
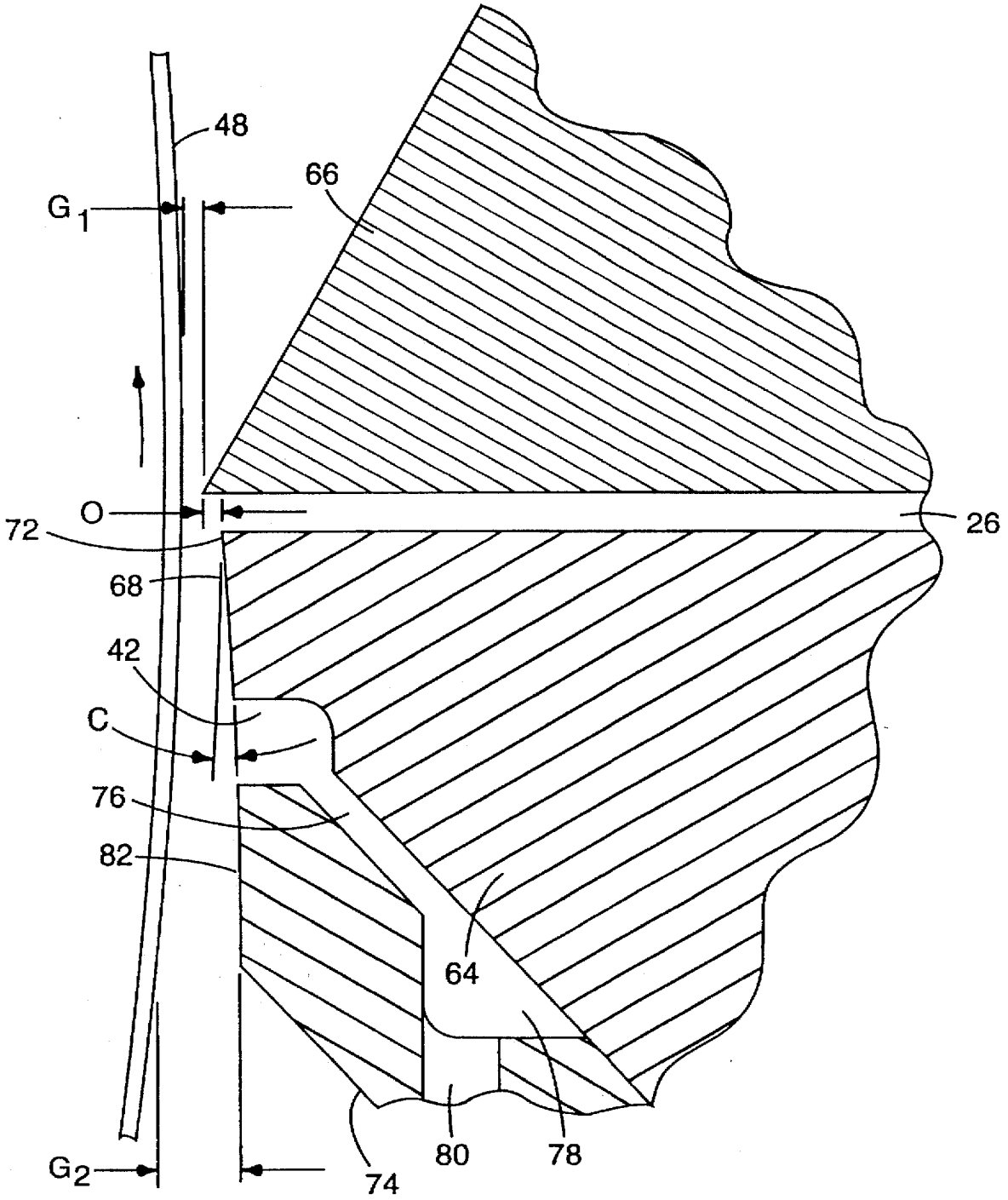
FIG. 6 is a cross-sectional view of an alternative vacuum chamber arrangement.

As shown in FIG. 6, the vacuum chamber 42 can be an integral part of, or clamped to, the upstream bar 64 to allow precise, repeatable vacuum system gas flow. The vacuum chamber 42 is formed using a vacuum bar 74 and can be connected through an optional vacuum restrictor 76 and a vacuum manifold 78 to a vacuum source channel 80. A curved vacuum land 82 can be an integral part of the upstream bar 64, or can be part of the vacuum bar 74, which is secured to the upstream bar 64. The vacuum land 82 has the same radius of curvature as the curved land 68. The curved land 68 and the vacuum land 82 can be finish-ground together so they are "in line" with each other. The vacuum land 82 and the curved land 68 then have the same convergence C with respect to the web 48.

The vacuum land gap $G_2$ is the distance between the vacuum land 82 and the web 48 at the lower edge of the vacuum land and is the sum total of the coating gap $G_1$, the overbite O, and the displacement caused by convergence C of the curved land 68. (Regardless of the location of $G_1$ in the drawings the gap is the perpendicular distance between the lower edge of the vacuum land and the web.) When the vacuum land gap $G_2$ is large, an excessive inrush of ambient air to the vacuum chamber 42 occurs. Even though the vacuum source may have sufficient capacity to compensate and maintain the specified vacuum pressure level at the vacuum chamber 42, the inrush of air can degrade coating performance.

Figure 7:
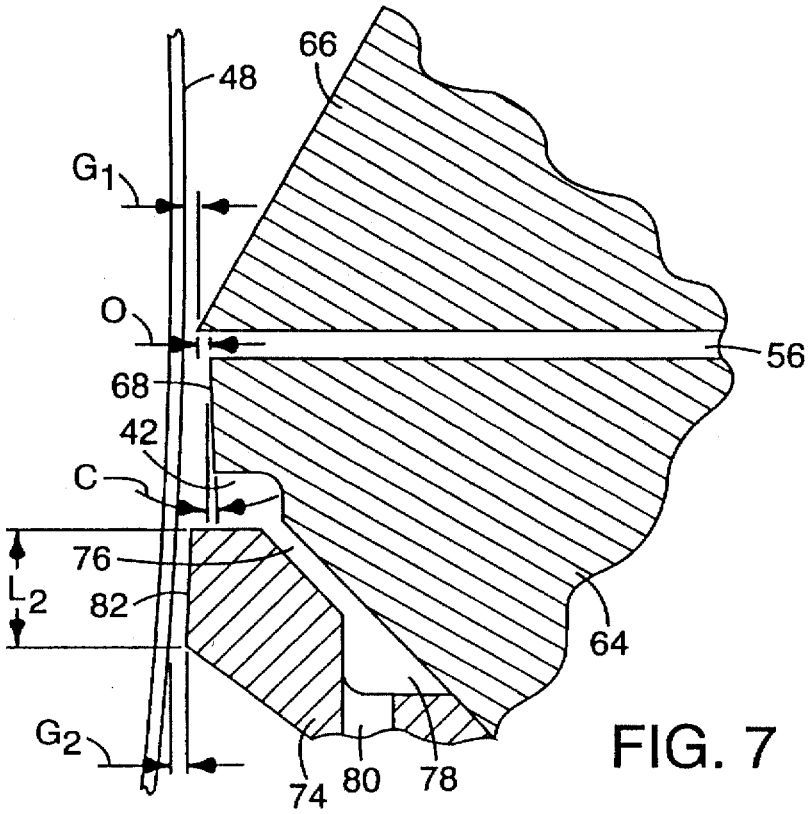
FIG. 7 is a cross-sectional view of another alternative vacuum chamber arrangement.

In FIG. 7, the vacuum land 82 is part of a vacuum bar 74 which is attached to the upstream bar 64. During fabrication, the curved land 68 is finished with the convergence C "ground in." The vacuum bar 74 is then attached and the vacuum land 82 is finish ground, using a different grind center, such that the vacuum land 82 is parallel to the web 48, and the vacuum land gap $G_2$ is equal to the coating gap $G_1$ when the desired overbite value is set. The vacuum land length $L_2$ may range from 6.35 mm to 25.4 mm. The preferred length $L_2$ is 12.7 mm. This embodiment has greater overall coating performance capability in difficult coating situations than the embodiment of FIG. 6, but it is always finish ground for one specific set of operating conditions. So, as coating gap $G_1$ or overbite O are changed vacuum land gap $G_2$ may move away from its optimum value.

Figure 8:
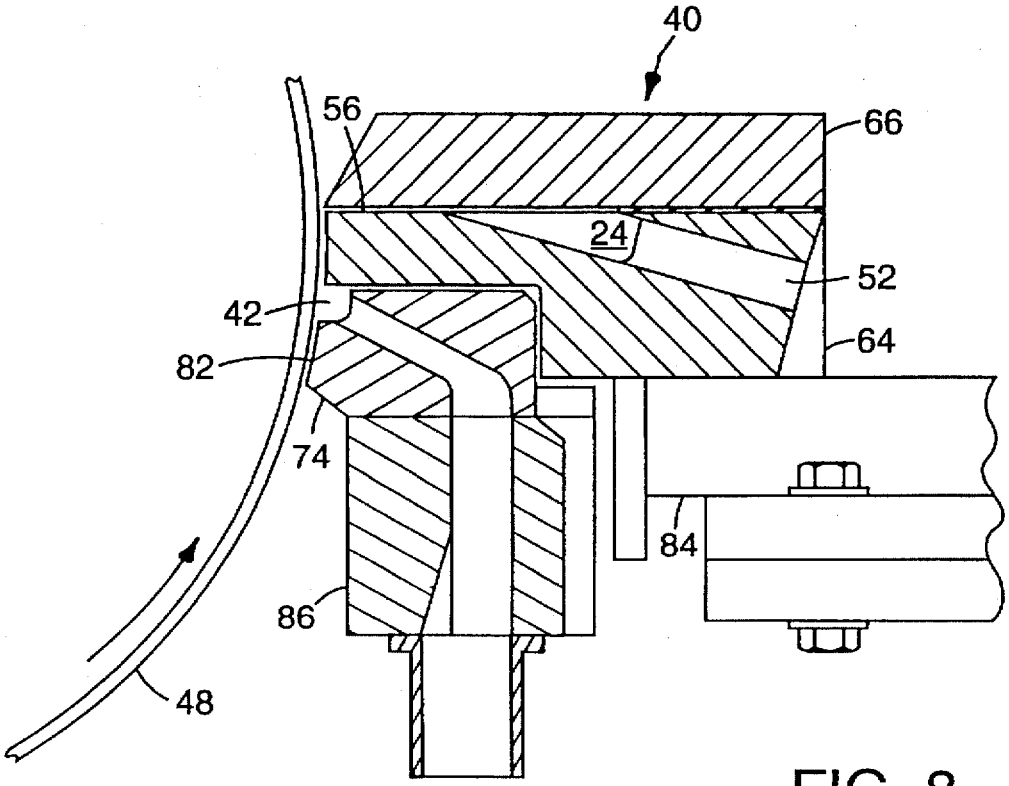
FIG. 8 is a cross-sectional view of an alternative extrusion die of the present invention.
Figure 9A:
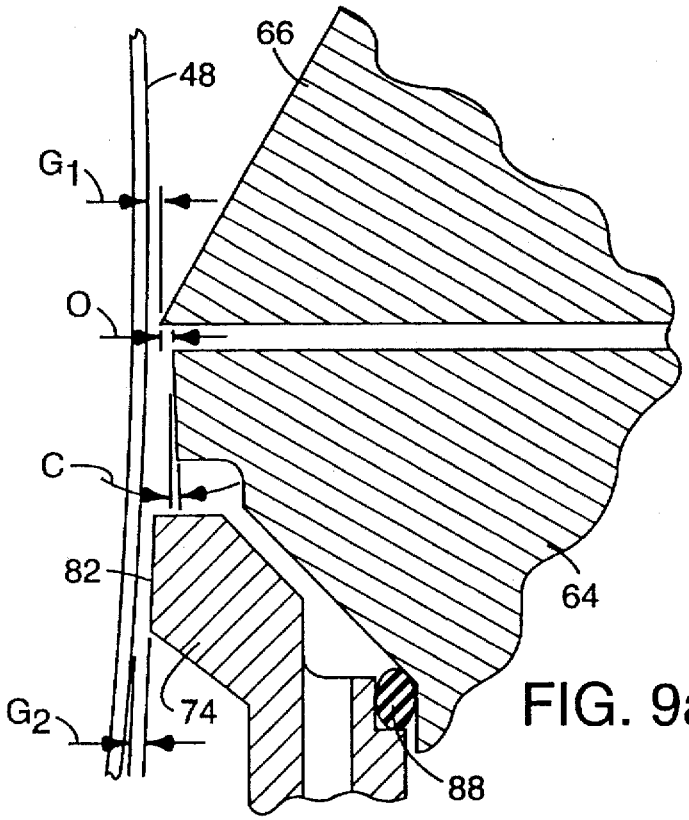
FIGS. 9*a* and 9*b* are enlarged cross-sectional views of the slot, face, and vacuum chamber of the die of FIG. 8.
Figure 9B:
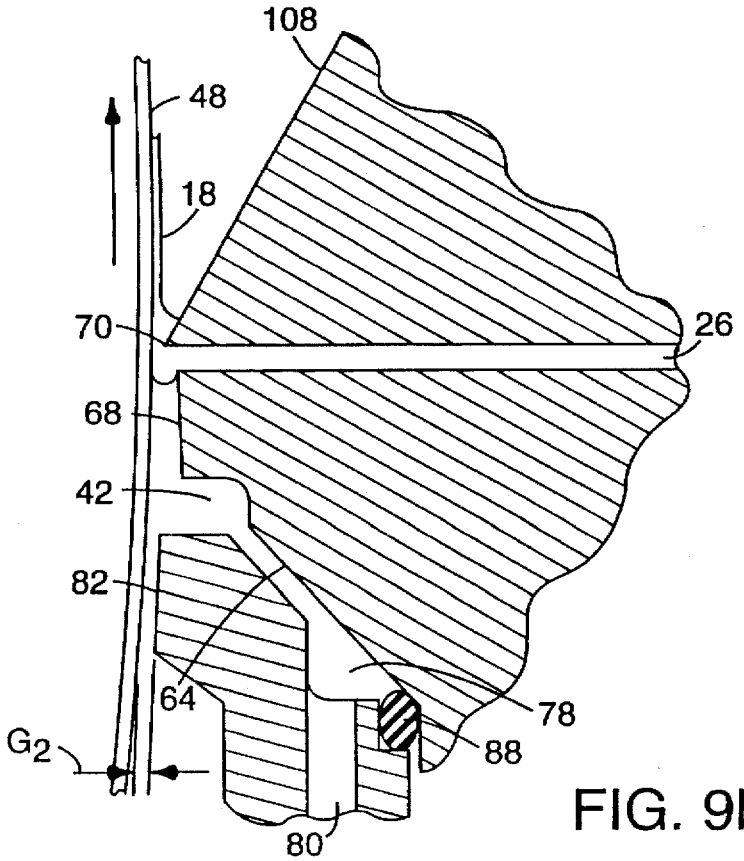

In FIGS. 8 and 9 the upstream bar 64 of the die 40 is mounted on an upstream bar positioner 84, and the vacuum bar 74 is mounted on a vacuum bar positioner 86. The curved land 68 on the upstream bar 64 and the vacuum land 82 on the vacuum bar 74 are not connected directly to each other. The vacuum chamber 42 is connected to its vacuum source through the vacuum bar 74 and the positioner 86. The mounting and positioning for the vacuum bar 74 are separate from those for the upstream bar 64. This improves performance of the die and allows precise, repeatable vacuum system gas flow. The robust configuration of the vacuum bar system also aids in the improved performance as compared with known systems. Also, this configuration for the vacuum bar 74 could improve performance of other known coaters, such as slot, extrusion, and slide coaters. A flexible vacuum seal strip 88 seals between the upstream bar 64 and the vacuum bar 74.

The gap $G_2$ between the vacuum land 82 and the web 48 is not affected by coating gap $G_1$, overbite O, or convergence C changes, and may be held at its optimum value continuously, during coating. The vacuum land gap $G_2$ may be set within the range from 0.076 mm to 0.508 mm. The preferred value for the gap $G_2$ is 0.15 mm. The preferred angular position for the vacuum land 82 is parallel to the web During coating, the vacuum level is adjusted to produce the best quality coated layer. A typical vacuum level, when coating a 2 centipoise coating liquid at 6 microns wet layer thickness and 30.5 m/min web speed, is 51 mm $H_2O$. Decreasing wet layer thickness, increasing viscosity, or increasing web speed could require higher vacuum levels exceeding 150 mm $H_2O$. Dies of this invention exhibit lower satisfactory minimum vacuum levels and higher satisfactory maximum vacuum levels than known systems, and in some situations can operate with zero vacuum where known systems cannot.

Figure 10A:
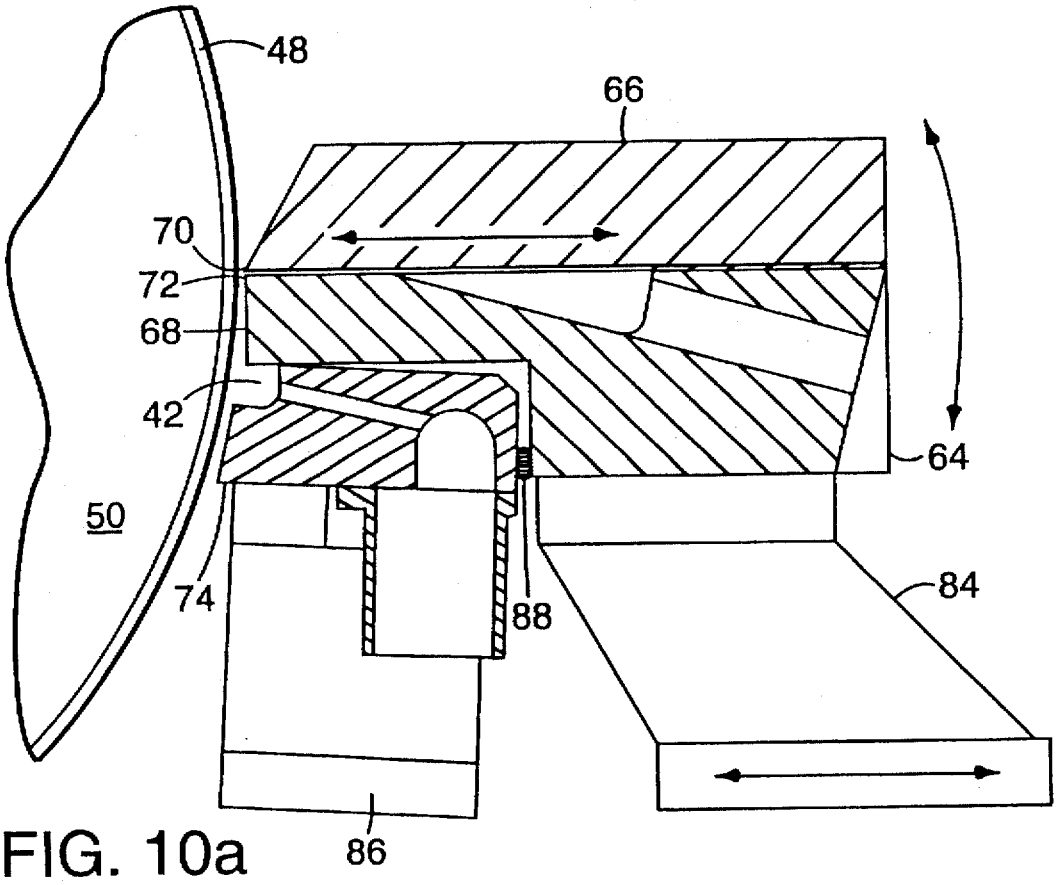
FIGS. 10*a* and 10*b* are schematic views of the die of FIG. 8.
Figure 10B:
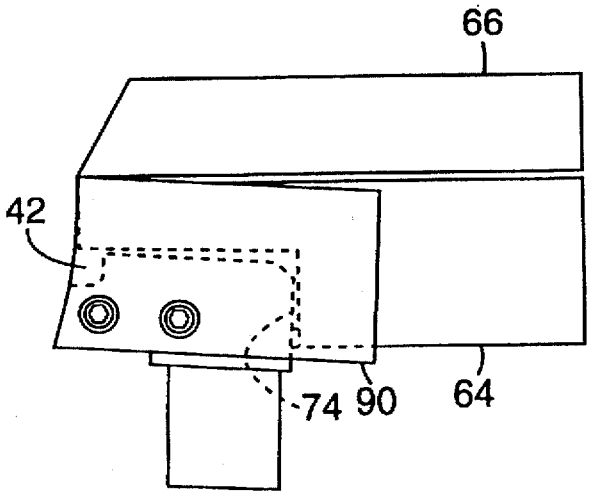

FIGS. 10*a* and 10*b* show some positioning adjustments and the vacuum chamber closure. Overbite adjustment translates the downstream bar 66 with respect to the upstream bar 64 such that the sharp edge 70 moves toward or away from the web 48 with respect to the downstream edge 72 of the curved land 68. Adjusting convergence rotates the upstream bar 64 and the downstream bar 66 together around an axis running through the downstream edge 72, such that the curved land 68 moves from the position shown in FIG. 10, away from parallel to the web 48, or back toward parallel. Coating gap adjustment translates the upstream bar 64 and the downstream bar 66 together to change the distance between the sharp edge 70 and the web 48, while the vacuum bar remains stationary on its mount 86, and the vacuum seal strip 88 flexes to prevent air leakage during adjustments. Air leakage at the ends of the die into the vacuum chamber 42 is minimized by end plates 90 attached to the ends of the vacuum bar 74 which overlap the ends of the upstream bar 64. The vacuum bar 74 is 0.10 mm to 0.15 mm longer than the upstream bar 64, so, in a centered condition, the clearance between each end plate 90 and the upstream bar 64 will range from 0.050 mm to 0.075 mm.

One unexpected operating characteristic has been observed during coating. The bead does not move significantly into the space between the curved land 68 and the moving web 48, even as vacuum is increased. This allows using higher vacuum levels than is possible with known extrusion coaters, and provides a correspondingly higher performance level. Even where little or no vacuum is required, the invention exhibits improved performance over known systems. That the bead does not move significantly into the space between the curved land 68 and the web 48 also means that the effect of "runout" in the backup roller 50 on downstream coating weight does not differ from that for known extrusion coaters.

Figure 11:
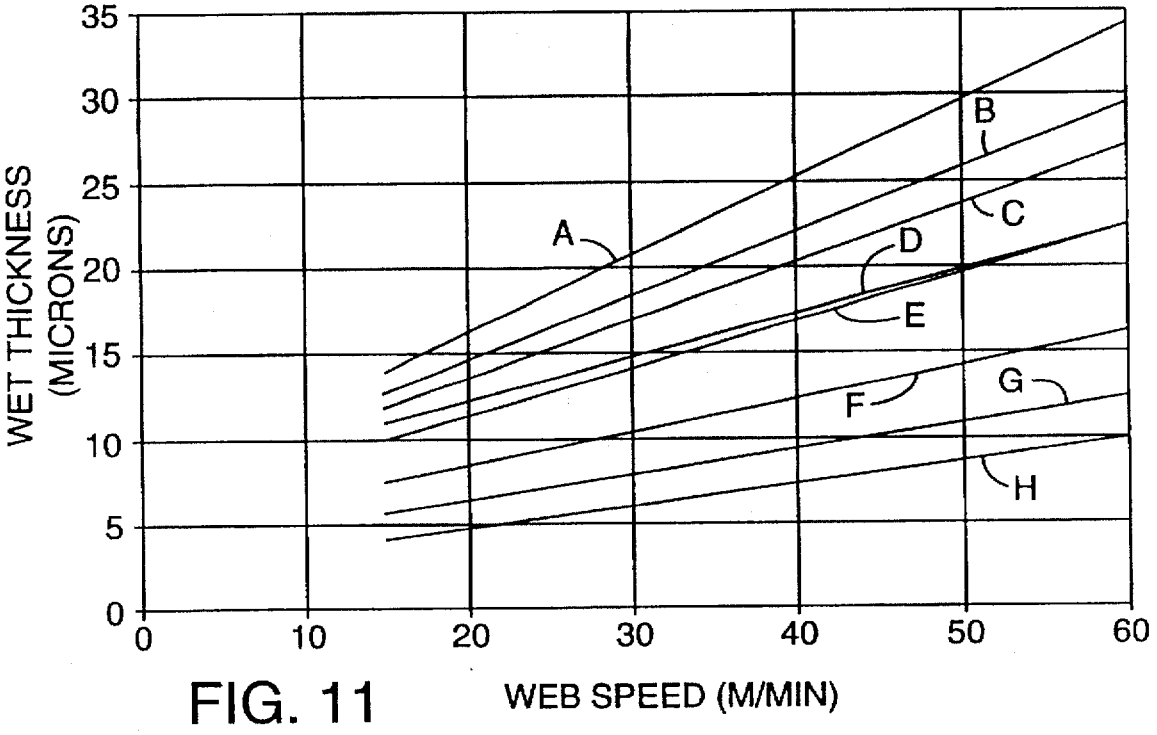
FIG. 11 shows coating test results which compare the performance of a known extrusion die and an extrusion die of the present invention for a coating liquid of 1.8 centipoise viscosity.
Figure 12:
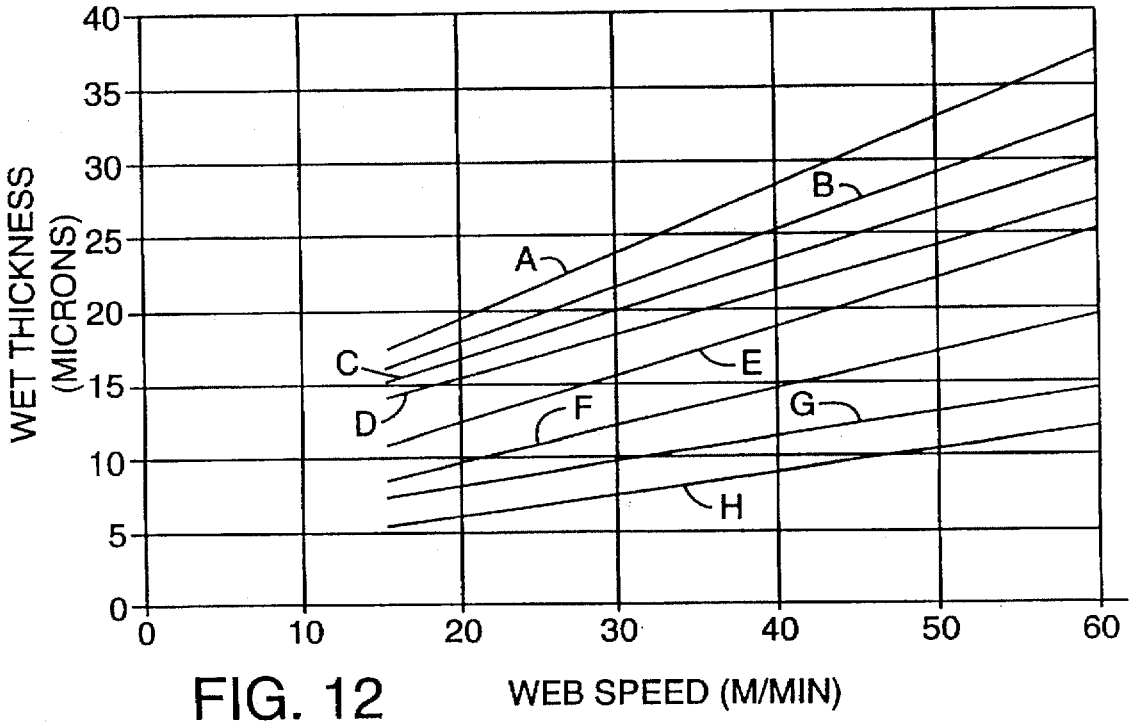
FIG. 12 shows comparative test results for a coating liquid of 2.7 centipoise viscosity.

FIG. 11 graphs results of coating tests which compare the performance of a known extrusion die with an extrusion die of this invention. In the tests, the 1.8 centipoise coating liquid containing an organic solvent was applied to a plain polyester film web. The performance criterion was minimum wet layer thickness at four different coating gap levels for each of the two coating systems, over the speed range of 15 to 60 m/min. Curves A, B, C, and D use the known, prior art die and were performed with coating gaps of 0.254 mm, 0.203 mm, 0.152 mm, and 0.127 mm, respectively. Curves E, F, G, and H use a die according to this invention at the same respective coating gaps. The lower wet thickness levels for this invention, compared to the prior art die, are easily visible. FIG. 12 shows comparative test results for a similar coating liquid of 2.7 centipoise viscosity, at the same coating gaps. Once again, the performance advantage for this invention is clearly visible.

FIG. 13 is a collection of data from coating tests where liquids at seven different viscosities, and containing different organic solvents, were applied to plain polyester film webs. The results compare performance of the prior art extrusion coater (PRIOR) and this invention (NEW). The performance criteria are mixed. Performance advantages for this invention can be found in web speed (Vw), wet layer thickness (Tw), coating gap, vacuum level, or a combination of these.

Figure 14:
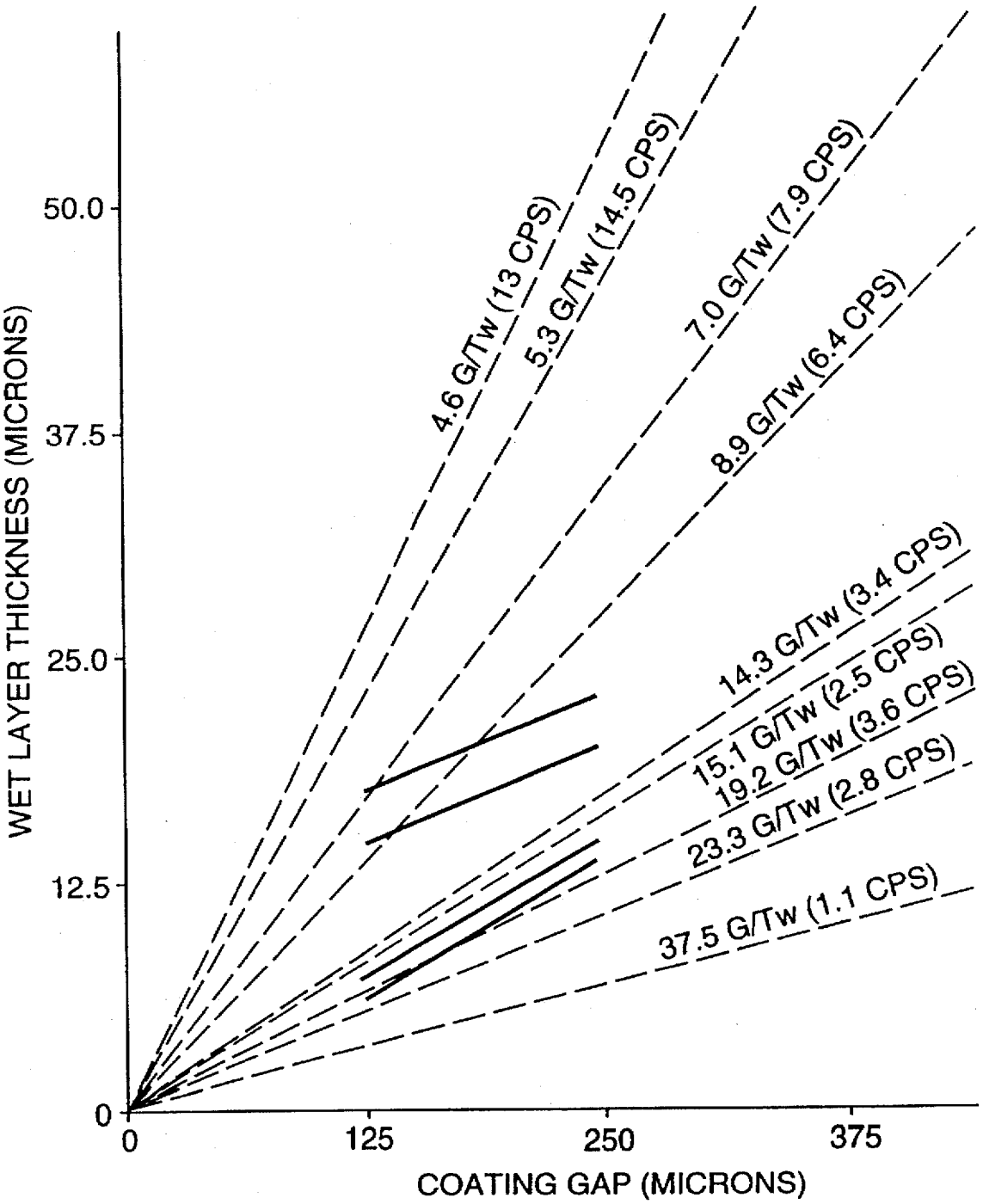
FIG. 14 is a graph of constant G/Tw lines for an extrusion coating die of the present invention for nine different coating liquids.

One measure of coater performance is the ratio of coating gap to wet layer thickness (G/Tw), for a particular coating liquid and web speed. FIG. 14 shows a series of constant G/Tw lines and viscosity values of an extrusion die of this invention, for nine different coating liquids. The liquids were coated on plain polyester film base at a web speed of 30.5 m/min. A few viscosity values appear to be out of order, due to the effect of other coatability factors. Four additional performance lines have been added after calculating the G/Tw values for 30.5 m/min web speed from FIGS. 11 and 12. From top to bottom, the solid performance lines are the G/Tw for liquids of 2.7 centipoise and 1.8 centipoise coated by a known extrusion die and the G/Tw for liquids of 2.7 centipoise and 1.8 centipoise coated by an extrusion die of this invention. The lines for of this invention represent greater G/Tw values than the lines for of the prior art coating die. In addition, the lines for this invention are close to being lines of constant G/Tw, averaging 18.8 and 16.8, respectively. The lines of the known coater show considerably more G/Tw variation over their length. This invention has a much improved operating characteristic for maintaining a coating bead at low wet thickness values, over known systems.

Figure 15:
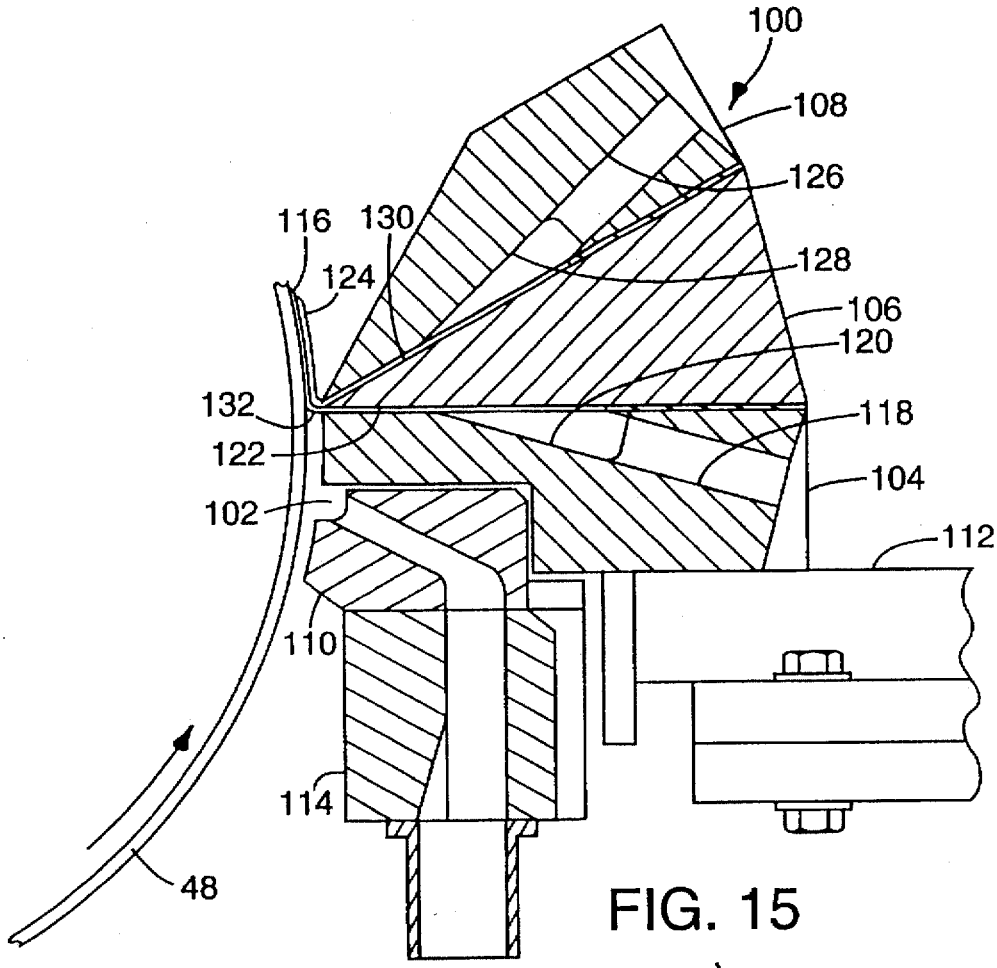
FIG. 15 is a cross-sectional view of a multiple layer extrusion die according to the present invention.
Figure 16:
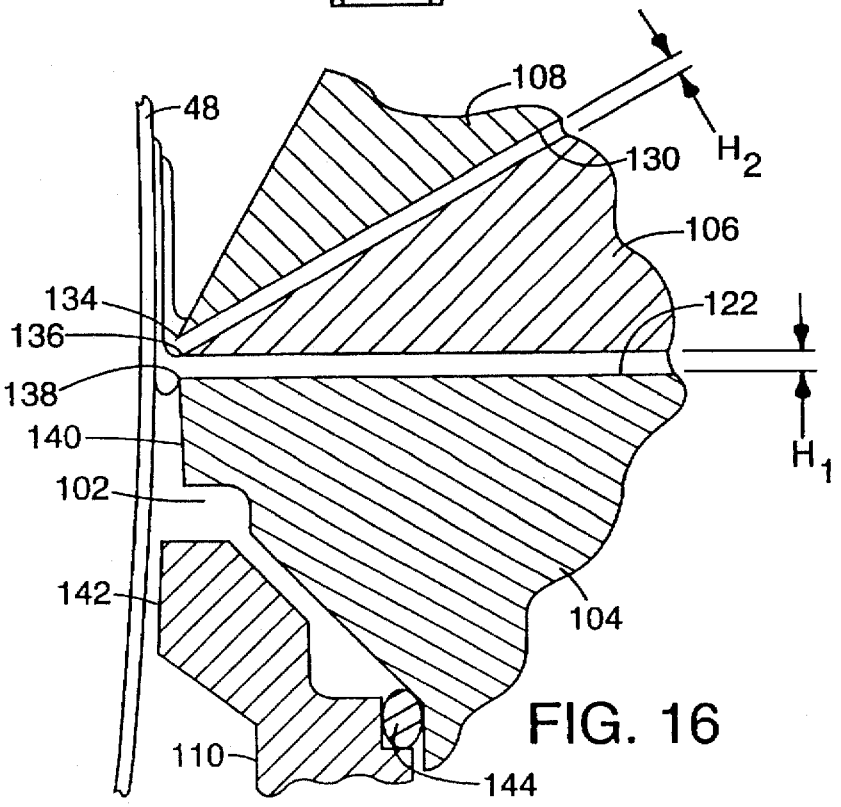
FIG. 16 is a cross-sectional view of the face and vacuum chamber of the die of FIG. 15.

FIGS. 15 and 16 show a multiple layer extrusion die 100 with a vacuum chamber 102 of this invention. The die 100 includes an upstream bar 104, a wedge bar 106, and a downstream bar 108. Vacuum pressure for the vacuum chamber 102 is supplied through a vacuum bar 110. The upstream bar 104 is mounted on an upstream bar positioner 112 and the vacuum bar 110 is supported by a vacuum bar positioner 114. A first coating liquid 116 is supplied through a first channel 118 to a first manifold 120 for distribution through a first slot 122 to form a first wet coated layer on the web 48. A second coating liquid 124 is supplied through a second channel 126 to a second manifold 128 for distribution through a second slot 130 to form a second wet coated layer on the first coated layer. The two liquids are brought together at the coating bead 132.

Alternatively, the second channel 126 could be formed in the wedge bar 106. Additionally, channels (not shown) can be formed transversely through the die 100, such as through the wedge bar 106. The channels can receive cool or warm water or other fluid to cool or heat the die.

In this configuration, two sharp edges, downstream edge 134 and wedge edge 136, can have overbite adjustment. Two flow slots 122, 130, each can have slot height adjustment. It has been found that underbite in one of these two edges can improve the multiple layer coating situation in some cases. For both edges 134, 136 overbite (toward the web 48) and underbite (away from the web 48) are measured with respect to a downstream edge 138 of the curved land 140. The adjustment for the sharp edge 134 on the downstream bar 108, moving along the coating slot 130 can range from 0.51 mm underbite to 0.51 mm overbite. The adjustment for the wedge edge 136 on the wedge bar 106, moving along the coating slot 122 can range be from 0.51 mm underbite to 0.51 mm overbite. Both slot heights $H_1$, $H_2$ can range from 0.076 mm to 3.175 mm. With convergence on the curved land 140 set at 0.57°, and both slot heights at 0.254 mm, the preferred overbite values are 0.0 mm for the wedge edge 136 and 0.076 mm overbite for the downstream edge 134 on the downstream bar 108. The gap between the vacuum land 142 on the vacuum bar 110, and the web 48 can range from 0.076 mm to 0.508 mm, but preferably is 0.15 mm. A flexible seal strip 144 seals between the upstream bar 104 and the vacuum bar 110. The principles of this die also can be applied to multiple layer dies for coating three or more layers.

Figure 17:
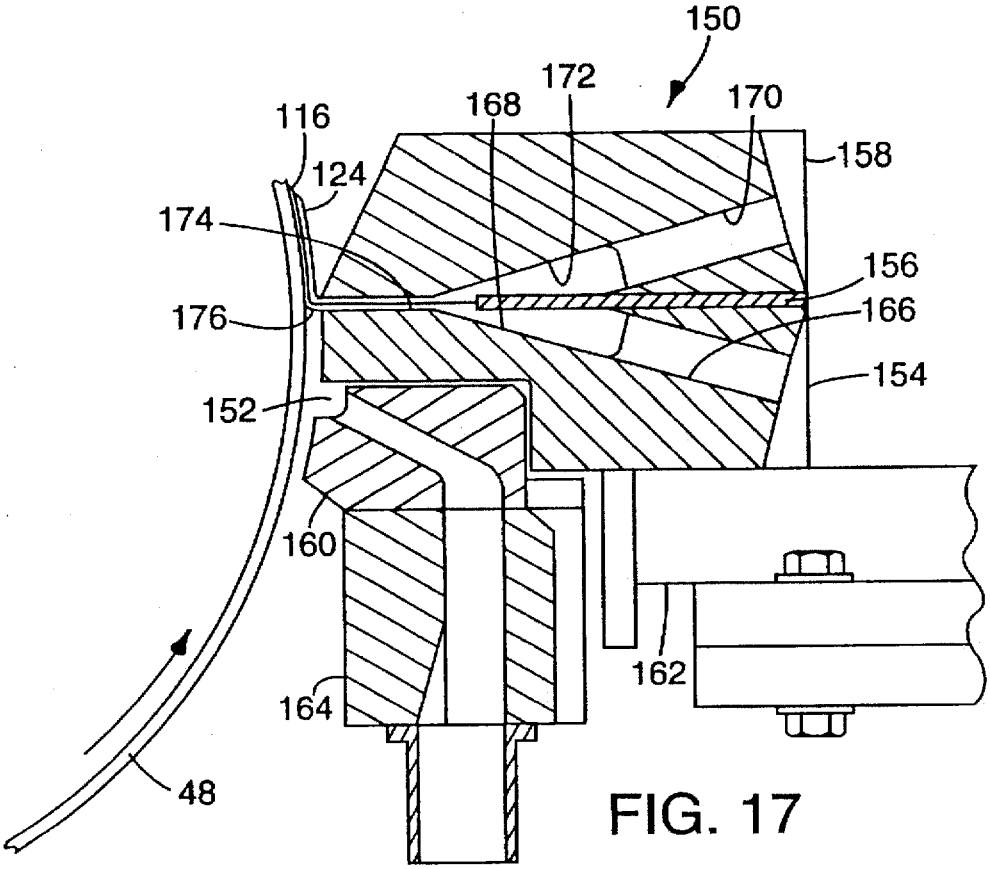
FIG. 17 is a cross-sectional view of another embodiment of a multiple layer extrusion die.
Figure 18:
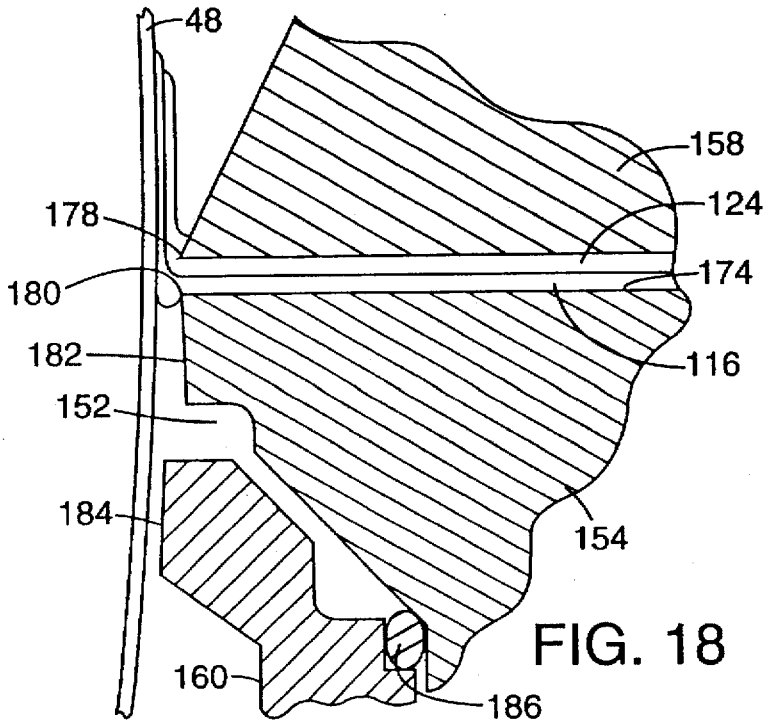
FIG. 18 is a cross-sectional view of the face and vacuum chamber of the die of FIG. 17.

FIGS. 17 and 18 show an alternative embodiment of a multiple layer extrusion die 150 with a vacuum chamber 152. The die 150 includes an upstream bar 154, a slot shim 156, and a downstream bar 158. Vacuum pressure for the vacuum chamber 152 is supplied through a vacuum bar 160. The upstream bar 154 is mounted on an upstream bar positioner 162 and the vacuum bar 160 is supported by a vacuum bar positioner 164. The first coating liquid 116 is supplied through a first channel 166 to a first manifold 168, while the second coating liquid 124 is supplied through a second channel 170 to a second manifold 172. The two coating liquids are brought together inside the die 150 and flow through the slot 174 as separate, laminar layers. The coating liquids 116, 124 pass through the coating bead 176, and form the two wet coated layers on the web 48. Alternatively, a wedge bar can be used in place of the slot shim 156 to separate the two manifolds 168, 172.

Only one sharp edge 178 on the downstream bar 158 is involved in overbite adjustment with respect to downstream edge 180 of the curved land 182 on the upstream bar 154. Ranges for slot height, overbite, and convergence are the same as those specified for FIG. 5. Preferably, the slot height is 0.18 mm, the overbite is 0.076 mm, and the convergence is 0.57°. The gap range between the vacuum land 184 on the vacuum bar 160 and the web 48 is from 0.076 mm to 0.508 mm, and preferably is 0.15 mm. A flexible seal strip 186 prevents leakage between the upstream bar 154 and the vacuum bar 160.

Figure 19:
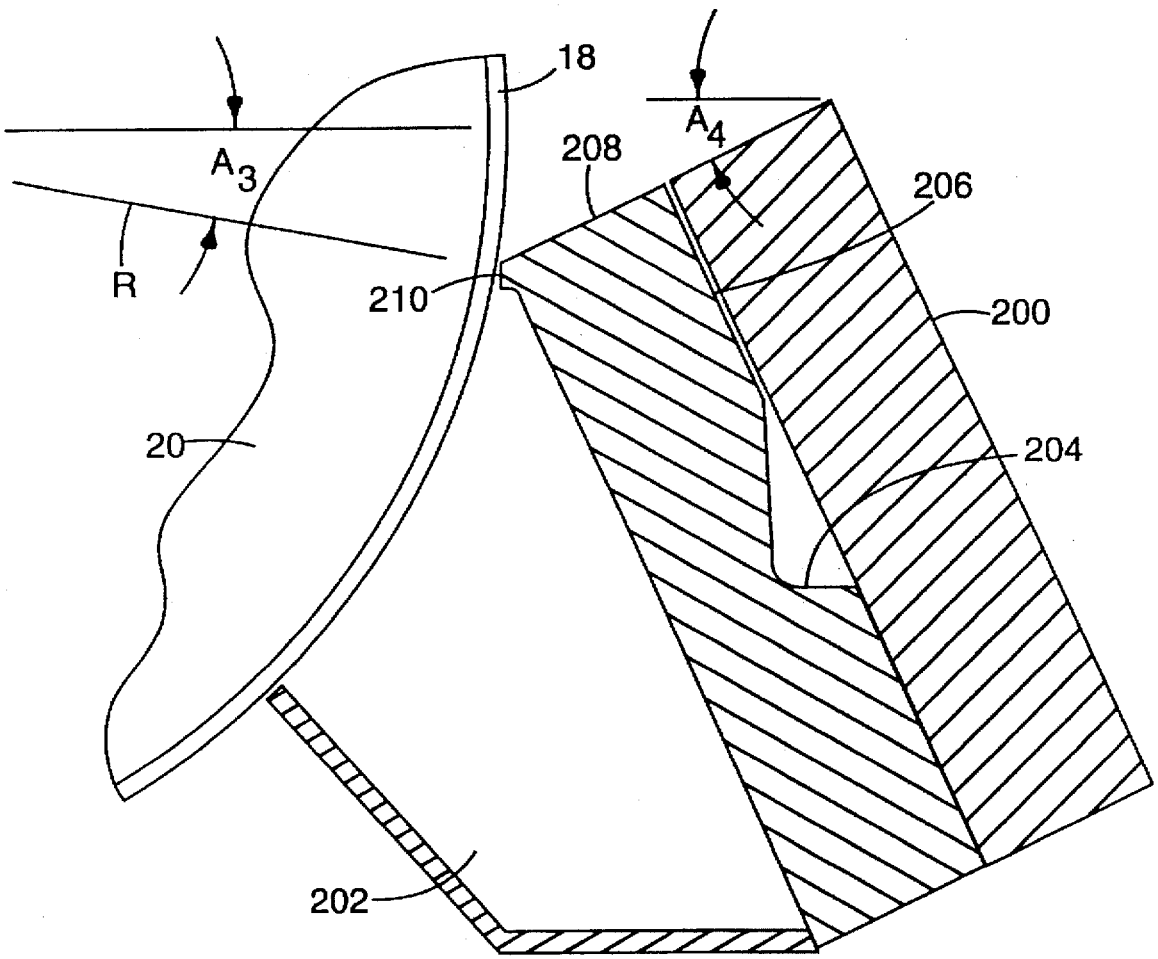
FIG. 19 PRIOR ART
FIG. 19 is a cross-sectional view of a known slide coating die.

FIG. 19 shows a known slide coating die 200 using a vacuum chamber 202 and having a liquid distribution manifold 204, a flow slot 206, and a slide surface 208. Coating liquid is coated onto a web 18 passing around a backup roller 20. A coating bead edge 210 is a 3.2 mm wide flat face extending across the die. The bead edge 210 is commonly positioned along a backup roller radius line R at an angle $A_3$, 10° below horizontal, to incline the die slide surface 208 at an angle $A_4$, 25° below horizontal.

Figure 20:
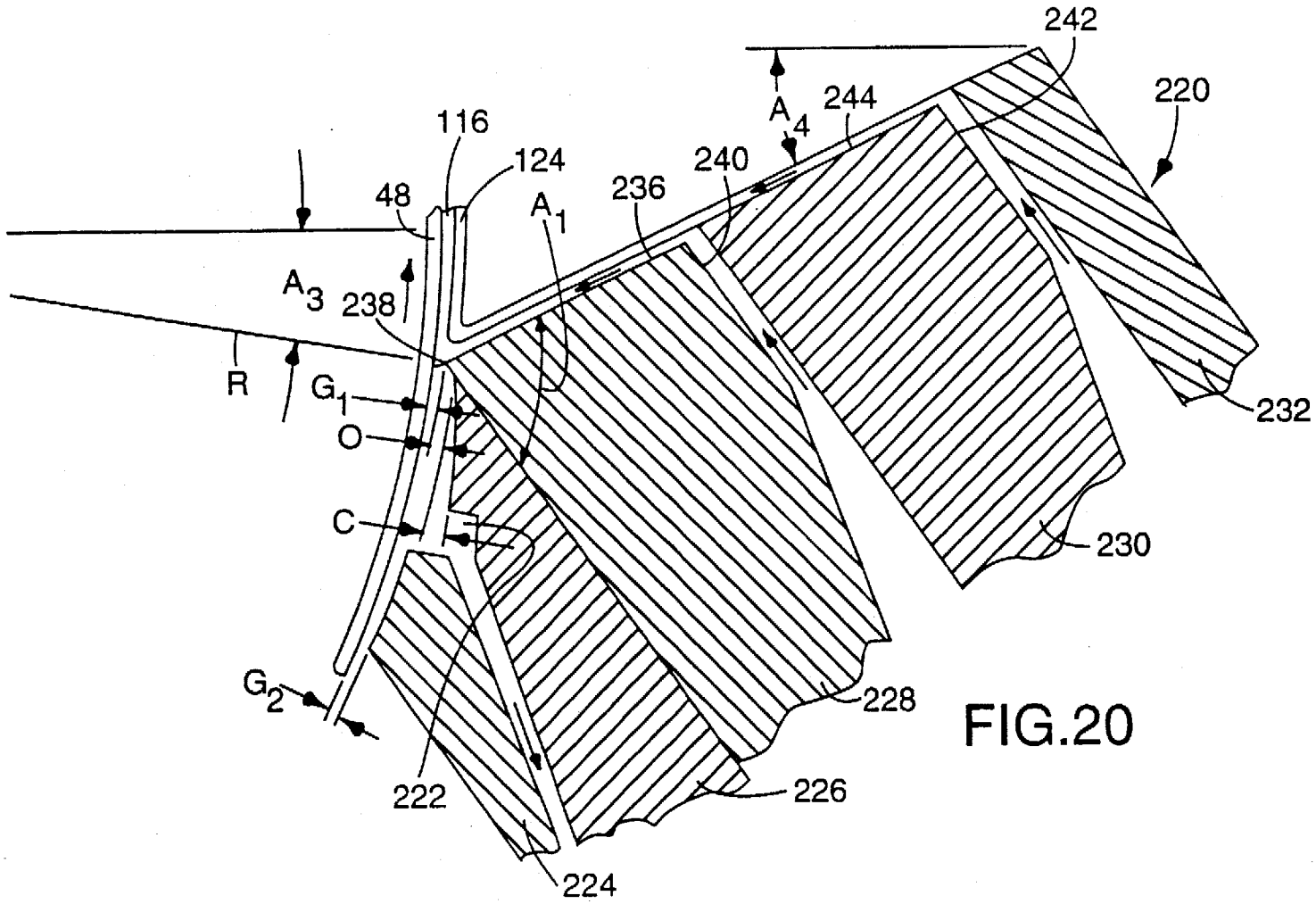
FIG. 20 is a cross-sectional view of a multiple layer slide coating die of the present invention.

FIG. 20 shows a multiple layer slide coating die 220 of the present invention having a conventional face angle using a vacuum chamber 222. The die 220 includes a vacuum bar 224, an upstream bar 226, a first manifold bar 228, a second manifold bar 230, and a downstream bar 232. The coating bead edge 238 is positioned along a backup roller radius line R at an angle $A_3$, 10° below horizontal, such that the die slide surface 236 is inclined at an angle $A_4$, 25° below horizontal. Dimensions and positions of interest are the bead edge angle $A_1$, the overbite O, the convergence C, the coating gap $G_1$, and the vacuum land gap $G_2$. There is no flow slot to supply coating liquid directly to the coating bead. The coating liquid flows down the slide surface 236 and over the bead edge 238. This slide coating die shows improved performance over known slide coaters. The bead edge angle $A_1$ can vary from 50° to 90°. The preferred bead edge angle $A_1$ is 80°. With convergence C set at 0.57°, the preferred overbite O is 0.076 mm. In operation, the first coating liquid 116 passes through the first slot 240 and down the slide surface 236 to the coating bead where it forms a first layer on the web 48. The second coating liquid 124 passes through a second slot 242 down the slide surface 244 and over the first coating liquid on the slide surface 236 to the coating bead where it forms a second layer on the first layer. Coating fluid can slide along the slide surface to form a continuous coating bead between the sharp edge and the surface being coated for application onto the surface without any of the coating fluid traveling between the sharp edge and the upstream land contacting the sharp edge is inserted.

Figure 21:
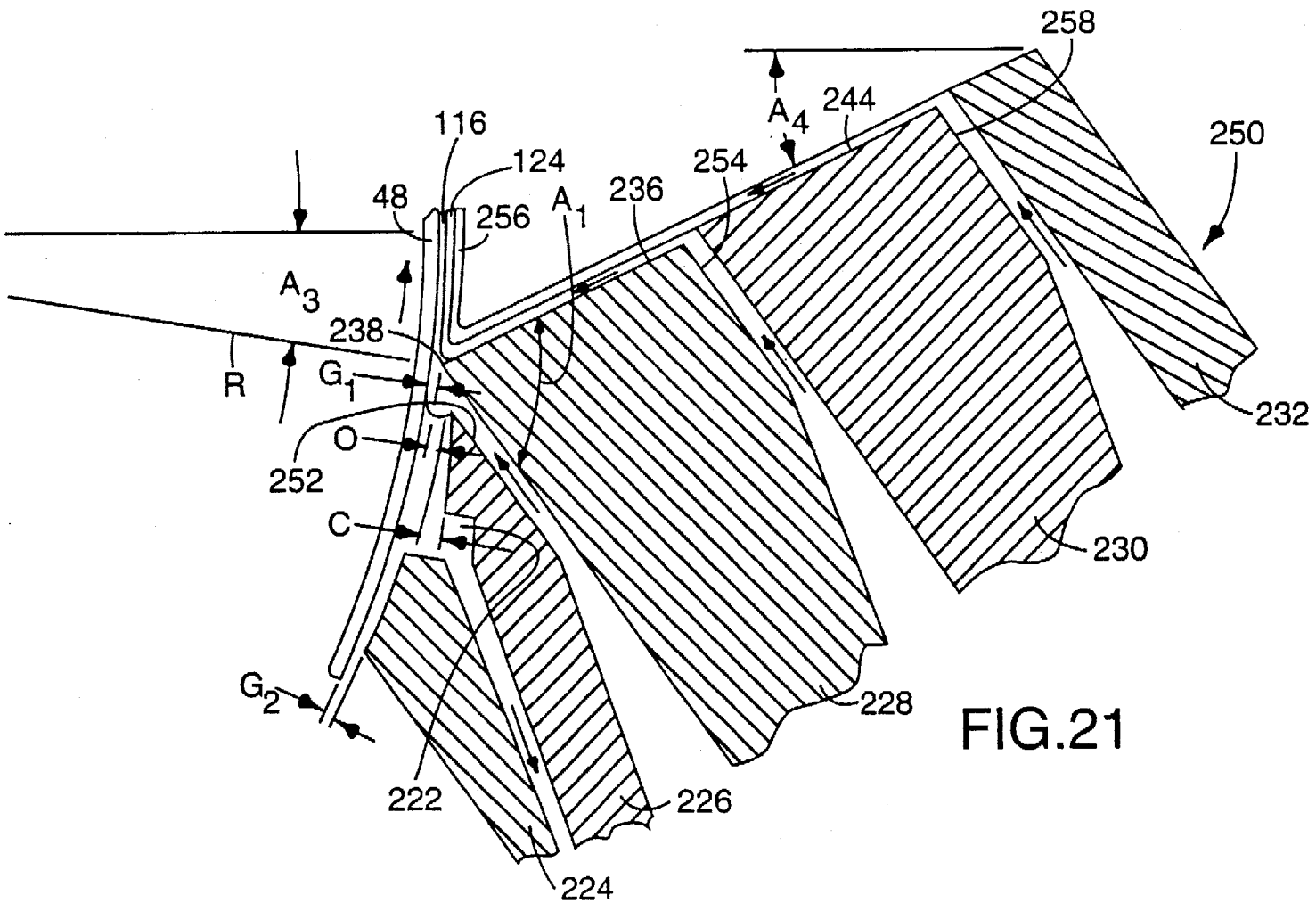
FIG. 21 is a cross-sectional view of a multiple layer, combination extrusion and slide coater of the present invention.

FIG. 21 shows a combination extrusion and slide coater 250 of the present invention which can be used with multiple or single layer, combination extrusion and slide coaters. The coater 250 includes a vacuum bar 224, an upstream bar 226, a first manifold bar 228, a second manifold bar 230, and a downstream bar 232. The bead edge 238 is positioned along a backup roller radius line R at an angle $A_3$, 10° below horizontal, such that the die slide surface 236 is inclined at an angle $A_4$, 25° below horizontal. Alternatively, the bead edge 238 can be positioned so that the fluid exiting from the first slot 252 exits perpendicular to the web 48 at the point of application.

Dimensions and positions of interest are the bead edge angle $A_1$, the first slot 252 height, the overbite O, the convergence C, the coating gap $G_1$, and the vacuum land gap $G_2$. The preferred bead edge angle $A_1$ is 80° With convergence set at 0.57°, and the first slot 252 height at 0.15 mm, the preferred overbite is 0.076 mm. The first liquid 116 passes through the first slot 252 to the coating bead, where it forms a first coated layer on the web 48. The second liquid 124 passes through the second slot 254 down slide surface 236 to the bead, where it forms a second coated layer on the first layer. The third coating liquid 256 passes through the third slot 258 down the slide surface 244 and over the second coating liquid 124 on the slide surface 236 to the bead, where it forms a third layer on the second layer.

Figure 22:
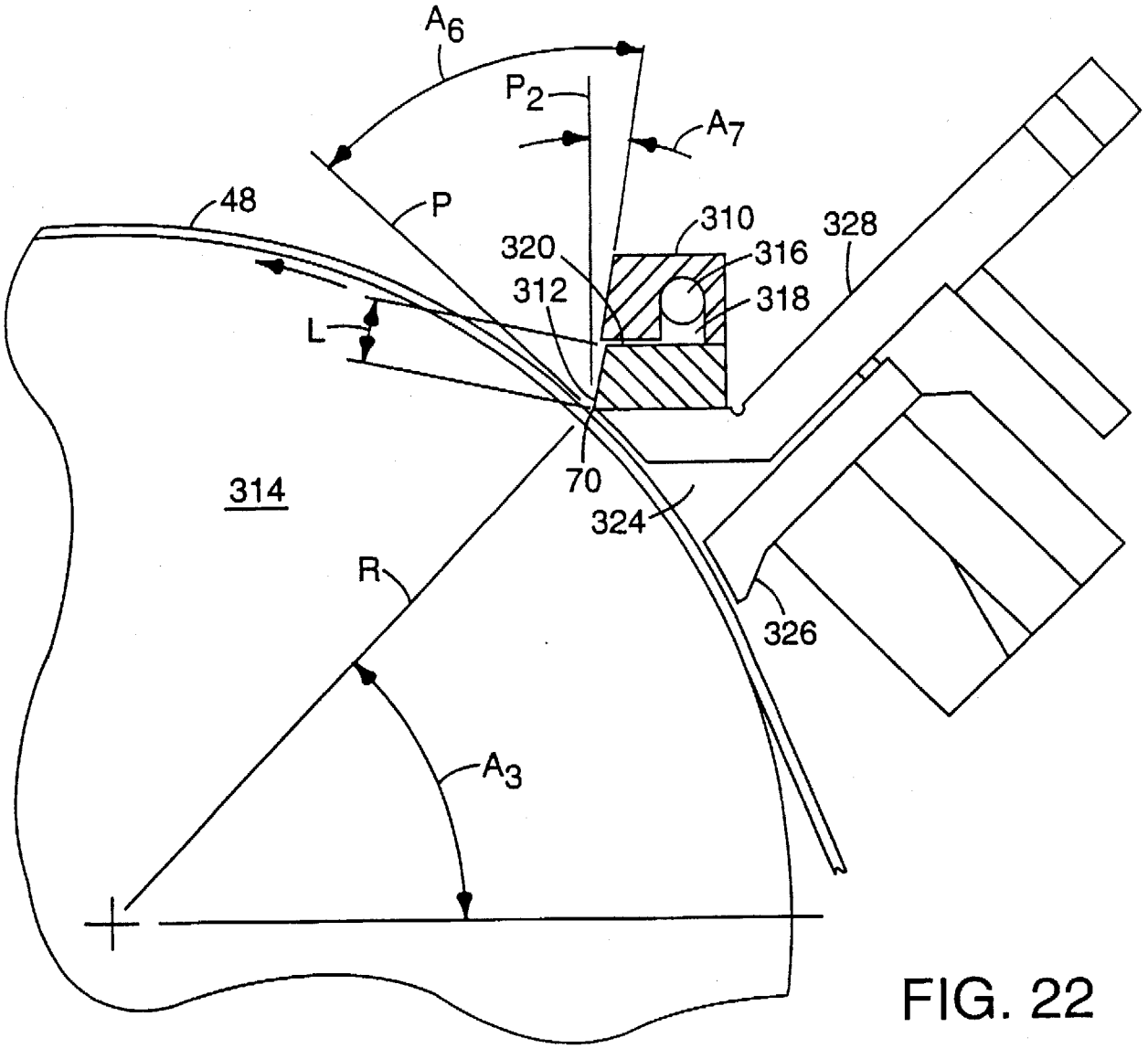
FIG. 22 is a cross-sectional view of the die according to another embodiment of the present invention.

A slide coating die of this invention using a steeper face angle than is possible with known systems is shown in FIG. 22. The die 310 is positioned with the coating bead edge along the radius line R at an angle $A_3$, ranging from 35° to 90° and preferably 45° above horizontal. The slide surface 312 is at an angle $A_6$, ranging from 30° to 75° and preferably 55° from the plane P tangent to the backup roller 314. This places the slide surface 312 at an angle $A_7$, 10° from vertical. Coating liquid is pumped through inlet channel 316 into a manifold 318 and through a coating slot 320 and down slide surface 312 to be coated onto the web 48. Bead stability is provided by a vacuum chamber 324, where the vacuum bar 326 is mounted and adjusted separately from the upstream bar support 328. Various slide surface lengths L can be chosen, depending on the coating liquid rheology and flow rate, to obtain a smooth, defect-free coating. The slide surface length L can range from 1.6 mm to 50.8 mm. Liquids with viscosities below 10 centipoise run better on slide lengths of 12.7 mm and less. Liquids with viscosities above 10 centipoise run better on slide lengths more than 12.7 mm.

In one example, the slide surface length was 38.1 mm, the overbite was 0.076 mm, and the convergence was 0.38°. Coating liquid having a viscosity of 100 centipoise was coated on aluminum foil at a web speed of 15.2 m/min. The vacuum was 63.5 mm $H_2O$, the coating gap was 0.508 mm, and the wet layer thickness was 0.027 mm (G/Tw=18.8). The coating was smooth and defect free.

Figure 23:
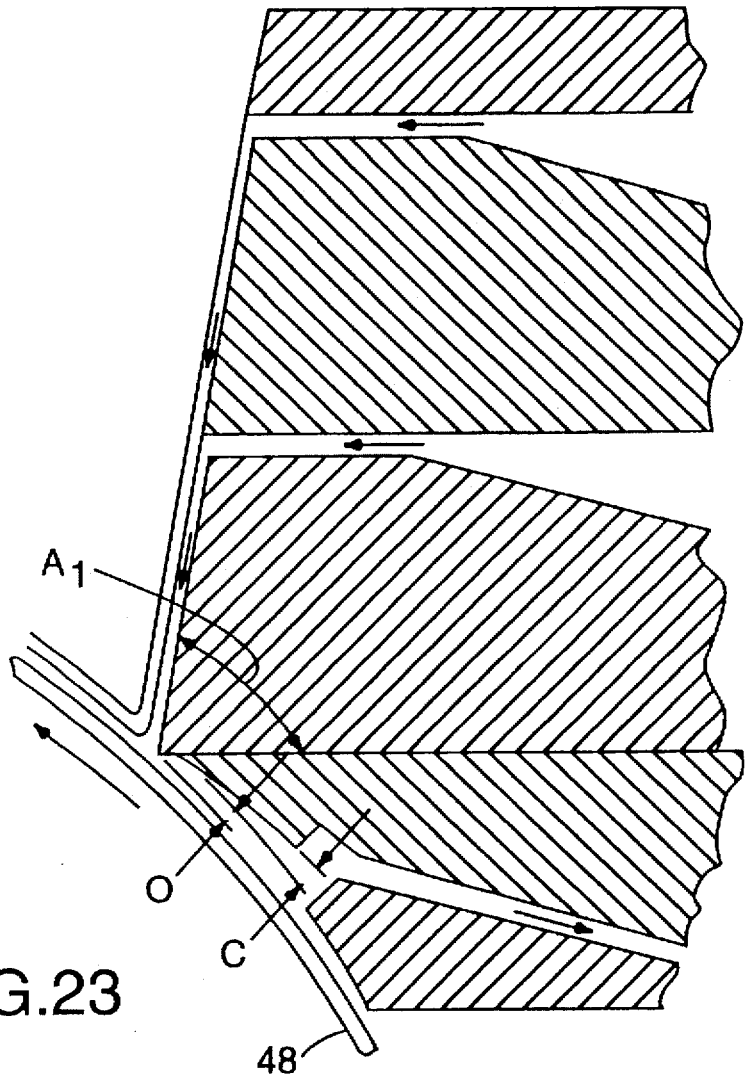
FIG. 23 is a cross-sectional view of a multiple layer version of the die of FIG. 22.
Figure 24:
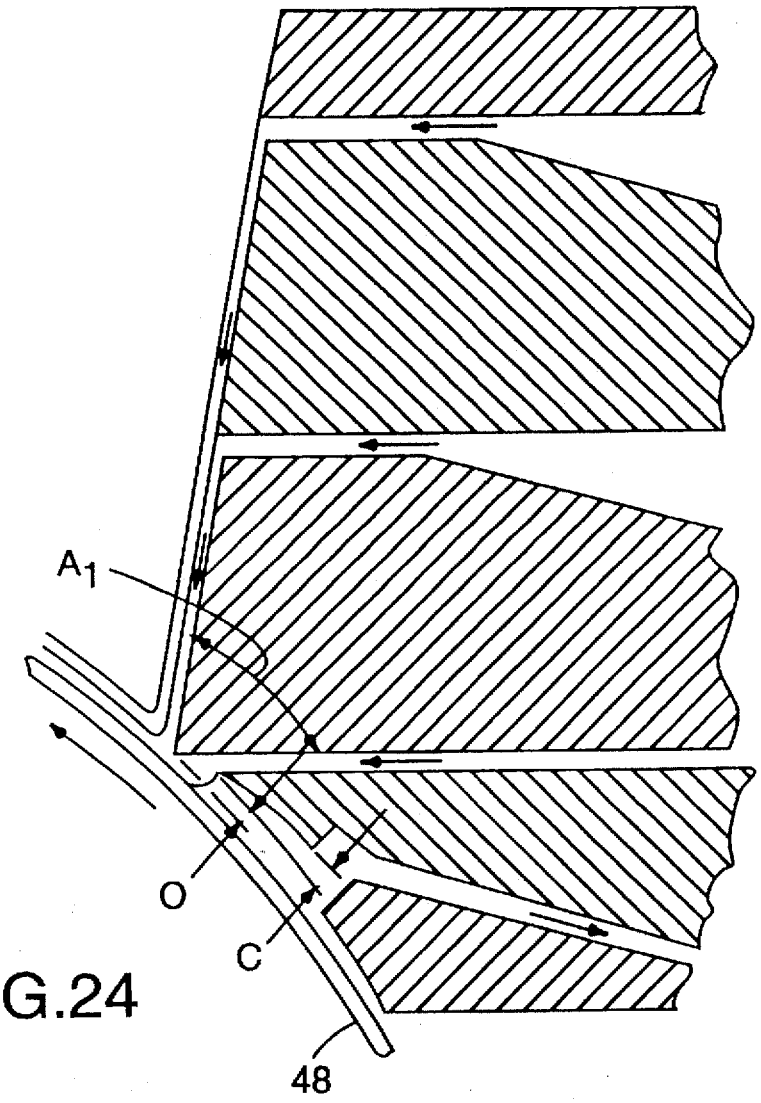
FIG. 24 is a cross-sectional view of a multiple layer, combination extrusion and slide version of the die of FIG. 22.

FIG. 23 shows a multiple layer version of the die of FIG. 22. FIG. 24 shows a multiple layer, combination extrusion and slide version of the die of FIG. 22. Overbite and convergence are as shown above. In both cases, the preferred edge angle $A_1$ is 80°.

We claim:

1. A method of die coating at least one coating fluid onto a surface comprising:

sliding a first coating fluid along a slide surface that has a sharp edge, and an upstream land contacting the sharp edge and spaced further from the surface than the sharp edge to form a continuous coating bead between the sharp edge and the surface being coated; and sliding the first coating fluid onto the surface without any coating fluid traveling between the sharp edge and the land, wherein the surface being coated has a shape, wherein the land has a shape which conforms to the shape of the surface being coated, and wherein the bead does not substantially move into a space between the land and the surface to be coated even when vacuum is applied and increased.

2. The method of claim 1 further comprising the steps of:

selecting a length of the land, an edge angle $A_1$ of the sharp edge defined between an outer surface and an inner surface that contacts the upstream land, and a coating gap distance between the sharp edge and the surface to be coated in combination with each other to improve coating performance by enabling more uniform coatings; and selecting overbite and convergence in combination with each other to improve coating performance by enabling more uniform coatings.

3. The method of claim 1 further comprising sliding a second coating fluid along the slide surface to form a continuous coating bead above the land and between the sharp edge and the surface being coated; and sliding the second coating fluid onto the first coating fluid without any second coating fluid traveling between the sharp edge and the land.

4. A coating apparatus for coating at least one coating fluid onto a surface comprising:

a slide surface having a sharp edge and an upstream land contacting the sharp edge and spaced further from the surface than the sharp edge; and first means for causing a first coating fluid to slide along the slide surface to form a continuous coating bead between the sharp edge and the surface being coated for application onto the surface without any of the first coating fluid traveling between the sharp edge and the land, wherein the surface being coated has a shape and wherein the land has a shape which conforms to the shape of the surface being coated.

5. The coating apparatus of claim 4 further comprising second means for causing a second coating fluid to slide along the slide surface to form a continuous coating bead above the land and between the sharp edge and the surface being coated for application onto the first coating fluid without any second coating fluid traveling between the sharp edge and the land.

6. The coating apparatus of claim 4 wherein the slide surface has a length of no more than 12.7 mm.

7. A coating apparatus for coating at least one coating fluid onto a surface comprising:

a slide surface having a sharp edge and an upstream land contacting the sharp edge and spaced further from the surface than the sharp edge; and first means for causing a first coating fluid to slide along the slide surface to form a continuous coating bead between the sharp edge and the surface being coated for application onto the surface without any of the first coating fluid traveling between the sharp edge and the land, wherein the slide surface is at an angle $A_6$ with a tangent plane of the web ranging from 30° through 75°.

8. The coating apparatus of claim 7 wherein the slide surface is at an angle $A_7$ with the vertical of 10°.

* * * * *